US008369741B2

(12) United States Patent
Holmes et al.

(10) Patent No.: US 8,369,741 B2
(45) Date of Patent: Feb. 5, 2013

(54) METHODS AND DEVICES FOR SEALING TONER OPENING PORTS OF PRINTER CARTRIDGES

(75) Inventors: Denny Holmes, Los Angeles, CA (US); Tigran Ohanyan, Reseda, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 385 days.

(21) Appl. No.: 12/799,705

(22) Filed: Apr. 30, 2010

(65) Prior Publication Data

US 2010/0212137 A1 Aug. 26, 2010

Related U.S. Application Data

(63) Continuation-in-part of application No. 11/894,414, filed on Aug. 21, 2007, now Pat. No. 7,835,664.

(60) Provisional application No. 61/214,987, filed on Apr. 30, 2009.

(51) Int. Cl.
*G03G 15/00* (2006.01)

(52) U.S. Cl. ..... 399/109; 156/94

(58) Field of Classification Search ..... 399/106, 399/109; 156/94, 381, 579, 580, 583.8
See application file for complete search history.

(56) References Cited

U.S. PATENT DOCUMENTS 5,876,541 A * 3/1999 Chitouras ..... 156/94
6,009,287 A * 12/1999 Goldie ..... 399/103

* cited by examiner

*Primary Examiner* — Walter L Lindsay, Jr.
*Assistant Examiner* — Barnabas Fekete

(57) ABSTRACT

There is provided a method of promoting adhesion of a printer cartridge seal to a printer cartridge. The method comprises providing a printer cartridge seal applicator having an applicator portion configured to apply pressure on a printer cartridge seal, an applicator body connected to the applicator portion, and a handle connected to the applicator body. The method further comprises positioning the printer cartridge seal applicator in between a toner supply roller and a printer cartridge surface defining a toner opening port. The method further comprises using the applicator portion to press the printer cartridge seal against the printer cartridge surface defining the toner opening port.

18 Claims, 29 Drawing Sheets

METHODS AND DEVICES FOR SEALING TONER OPENING PORTS OF PRINTER CARTRIDGES

CROSS REFERENCE TO RELATED APPLICATIONS

This application is a continuation-in-part and claims the benefit of priority from U.S. patent application Ser. No. 11/894,414, filed Aug. 21, 2007, which is incorporated herein by reference in its entirety. This application is also related to and claims the benefit of priority of U.S. provisional patent application Ser. No. 61/214,987, filed Apr. 30, 2009, which is incorporated herein by reference in its entirety.

BACKGROUND OF THE INVENTION a. Field of the Invention

The disclosure relates to electrophotography, particularly methods and devices for sealing toner opening ports of printer cartridges.

b. Background Art

Used printer cartridges of fax machines, copiers, inkjet printers, and laser printers are often remanufactured. The remanufacturing of printer cartridges may include cleaning, repairing damaged parts, replacing worn parts, and adding toner. Toner may be added into the printer cartridge by pouring toner into a toner hopper, which defines a toner opening port. During or after remanufacturing, the toner opening port usually has to be sealed so that toner will not leak during shipment and any time prior to the use of the cartridge.

Existing toner opening port sealing methods include using split type seals and insertion type seals. Split type seals are typically used when the remanufacturing process requires splitting of the printer cartridge, such as splitting a mag roller section and a toner hopper, to access and replace or service certain printer cartridge components. Insertion type seals are typically used when the printer cartridge does not have to be split during remanufacturing and are designed to be inserted through a toner opening port access hole or toner exit port on one side of a printer cartridge. Both split type seals and insertion type seals are adhered to printer cartridge walls or surfaces that define the toner opening port. Typically, once the adhesive of the seal is exposed, the seal may be left to adhere to the printer cartridge by itself. To further minimize toner from leaking around the seal, devices that can promote adhesion of the seal to the printer cartridge are desired. Where insertion seals are the appropriate seals to use, devices that may promote adhesion of the seal and that may not require splitting of the printer cartridge are desired and are addressed by this disclosure.

SUMMARY

There is provided in one embodiment a printer cartridge seal applicator. The printer cartridge seal applicator comprises an applicator portion configured to apply pressure on a printer cartridge seal. The printer cartridge seal comprises an adhesive. The printer cartridge seal applicator further comprises an applicator body connected to the applicator portion. The applicator body is configured to support the applicator portion. The printer cartridge seal applicator further comprises a handle connected to the applicator body. When the adhesive of the printer cartridge seal is exposed, the printer cartridge seal applicator substantially promotes adhesion of the adhesive of the printer cartridge seal to a printer cartridge portion.

There is provided in another embodiment a device for promoting adhesion of a printer cartridge seal to a printer cartridge. The device comprises an applicator means for applying pressure to the printer cartridge seal. The device further comprises a handle means for positioning the applicator means in between a toner supply roller and a printer cartridge portion defining a toner opening port. The handle means is connected to the applicator means.

There is provided in another embodiment an assembly for promoting adhesion of a printer cartridge seal to a printer cartridge portion that defines a toner opening port where the toner opening port is accessible through a toner exit port. The assembly comprises a fixture configured to support a printer cartridge. The fixture has a plurality of walls configured to minimize movement of the printer cartridge. The assembly further comprises a first printer cartridge seal applicator. The first printer cartridge applicator has a notched applicator portion configured to accommodate a printer cartridge seal pull strip, a first printer cartridge seal applicator body connected to the notched applicator portion, and a first printer cartridge seal applicator handle connected to the applicator body. The assembly further comprises a second printer cartridge seal applicator. The second printer cartridge seal applicator has a flat applicator portion configured to apply pressure on the printer cartridge seal, a second printer cartridge seal applicator body connected to the flat applicator portion, and a second printer cartridge seal applicator handle connected to the applicator body. The assembly further comprises a seal insertion tool for inserting the printer cartridge seal through the toner exit port.

There is provided in another embodiment a method of promoting adhesion of a printer cartridge seal to a printer cartridge. The method comprises providing a printer cartridge seal applicator comprising an applicator portion configured to apply pressure on the printer cartridge seal, an applicator body connected to the applicator portion, and a handle connected to the applicator body. The method further comprises positioning the printer cartridge seal applicator in between a toner supply roller and a printer cartridge surface defining a toner opening port. The method further comprises using the applicator portion to press the printer cartridge seal against the printer cartridge surface defining the toner opening port.

There is provided in another embodiment a method of promoting adhesion of a printer cartridge seal to a printer cartridge. The method comprises providing an assembly for promoting adhesion of a printer cartridge seal to a printer cartridge. The assembly comprises a fixture configured to support a printer cartridge, a first printer cartridge seal applicator having a notched applicator portion, a second printer cartridge seal applicator having a flat applicator portion, and a seal insertion tool. The method further comprises positioning the printer cartridge on the fixture. The method further comprises positioning the first printer cartridge seal applicator in between a toner supply roller and a first printer cartridge surface defining a toner opening port. The method further comprises inserting the printer cartridge seal through a toner exit port using the seal insertion tool. The method further comprises using the notched applicator portion to align and press the printer cartridge seal against the first printer cartridge surface defining the toner opening port. The method further comprises removing an adhesive backing from the printer cartridge seal. The method further comprises positioning the second printer cartridge seal applicator in between the toner supply roller and a second printer cartridge surface. The method further comprises using the second printer cartridge seal applicator to press the printer cartridge seal against a length of the printer cartridge.

The above description sets forth, rather broadly, a summary of embodiments of the disclosure so that the detailed description that follows may be better understood and contributions of the disclosure to the art may be better appreciated. Some of the embodiments of the disclosure may not include all of the features or characteristics listed in the above summary. There may be, of course, other features of the invention that will be described below and may form the subject matter of the below claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the disclosed embodiments. Also, it is to be understood that the phraseology and terminology employed herein are for the purpose of description and should not be regarded as limiting.

Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
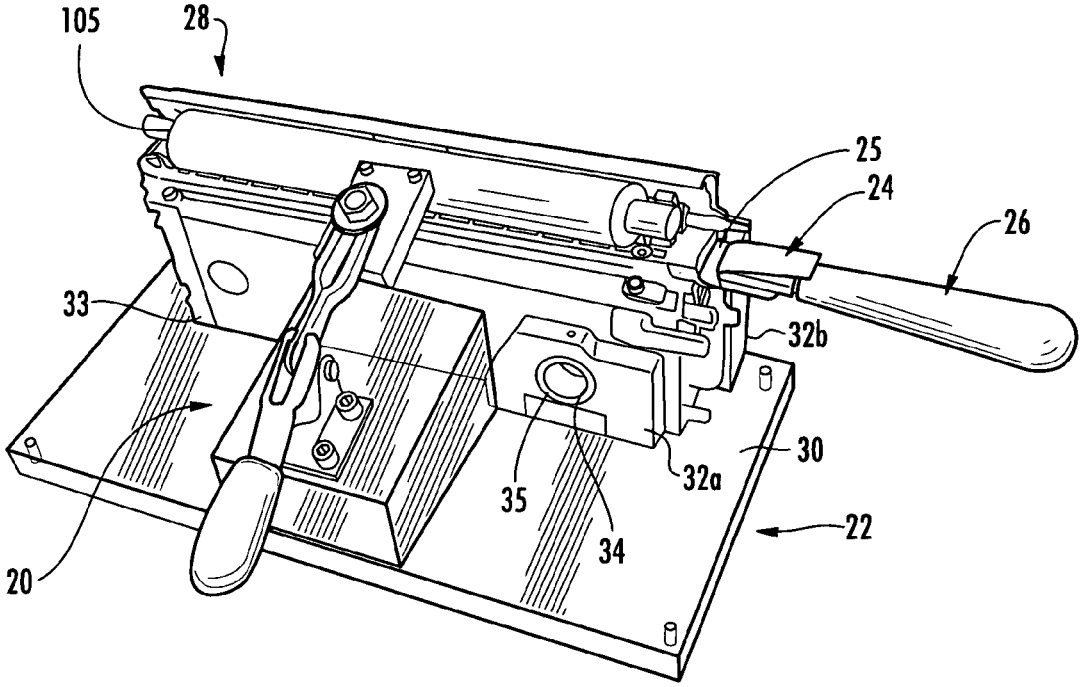
FIG. 1 is a perspective view of an embodiment of a device for sealing toner opening ports according to the disclosure.

The disclosed embodiments comprise methods and devices for sealing toner opening ports of printer cartridges. Referring to FIG. 1, the preferred embodiment of the device for sealing toner opening ports of printer cartridges preferably includes a seal 24, a seal insertion tool 26, a seal clamp 20, and a fixture 22. The seal 24 may be an insertion type seal. The seal 24 preferably provides a seal for the toner opening port (not shown) of the printer cartridge 28 so that toner is substantially prevented from leaking or escaping from the toner hopper prior to the use of the printer cartridge 28. Upon the first use of the printer cartridge 28, the portion of the seal 24 that covers the toner opening port may be detached from the printer cartridge 28.

The seal 24 may be installed by inserting it through the toner exit port 25, which leads to the toner opening port. The seal 24 may then be attached to the printer cartridge portion that surrounds the toner opening port. The seal insertion tool 26 preferably aids in the insertion of the seal through the toner exit port 25. The seal clamp 20 preferably provides substantially uniform pressure to the seal 24 so that the seal 24 can adhere substantially well to the printer cartridge 28, and toner leakage can substantially be prevented. The seal clamp 20 may be attached to the fixture 22, which may provide support to the printer cartridge 28 at least while the seal is being attached to it. The fixture 22 may also be configured to provide support to the printer cartridge 28 while other remanufacturing work is being performed on the printer cartridge 28, such as when toner is being refilled.

Fixture—The fixture 22 is preferably configured to support the printer cartridge 28 with its base 30 and walls 32*a-c*. The walls 32*a-c* of the fixture 22 may be attached perpendicular to the base 30 and may substantially prevent or substantially minimize movements of the printer cartridge 28 during the sealing process. One of the fixture walls, 32*a*, is preferably configured to be positioned adjacent to the toner hopper 33. Fixture wall 32*a* preferably defines a toner refill hole template 34. A hole saw (not shown) may be attached to an electric drill (not shown) and inserted into the toner refill hole template 34. The electric drill may then be activated to create a refill hole on the toner hopper 33 where toner may be added. The refill hole template 34 preferably includes at least one collar 35 positioned within the interior perimeter of the refill hole template 34. The collar 35 may be of predetermined diameter and height and is preferably configured to control the depth of the cut of the hole saw. A plurality of collars with varying internal diameters and heights may be provided. Controlling the depth of the cut of the hole saw may substantially prevent the hole saw from damaging printer cartridge components. After the desired amount of toner has been added, the refill hole may be covered.

Figure 2:
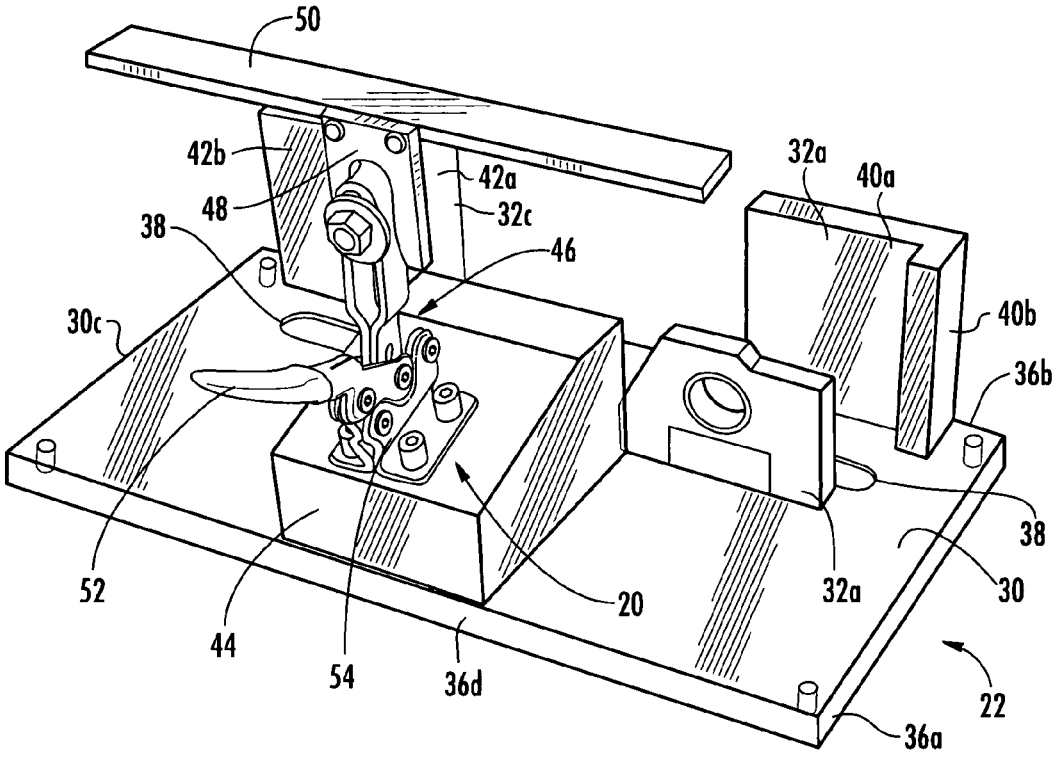
FIG. 2 is a perspective view of an embodiment of a fixture and a seal clamp according to the disclosure.

Referring now to FIG. 2, the base 30 of the fixture 22 may include four sides 36*a-d*. A groove 38 preferably spans substantially from side 36*a* to 36*c* of the base 30. A portion of the printer cartridge 28 may be positioned within the groove 38 to further control the movement of the printer cartridge 28 during the sealing process or remanufacturing work. Other than the area of the base that defines the groove 38, the base 30 preferably defines a substantially planar surface. Fixture walls 32*a-c* preferably stand perpendicular from the base 30. Walls 32*b* and 32*c* may each be comprised of two walls (40*a* and 40*b*, 42*a* and 42*b*) that are attached substantially perpendicular to each other to form a corner, which would further control movements of the printer cartridge 28. All the walls 32*a-c* preferably cooperate to prevent the printer cartridge 28 from moving forward, backward, or side-to-side relative to the base 30.

It is noted that terms relating to spatial orientation, such as "forward," "backward," and "side-to-side" are used herein for ease and clarity of description only. The disclosure is not limited by these spatial orientations and may be practiced without observing the descriptions that use these spatial orientations. The sizes, shapes, orientations, and positions of the walls or the groove may vary depending on the design of the printer cartridge or cartridge portion intended to be laid onto the base 30. In certain embodiments, the base may have indentations or holes in lieu of walls that are configured hold the printer cartridge. It can be realized that the fixture 22 of the disclosed embodiments affixes the printer cartridge to a substantially steady position, which may be ideal for performing manufacturing or remanufacturing work.

Figure 3:
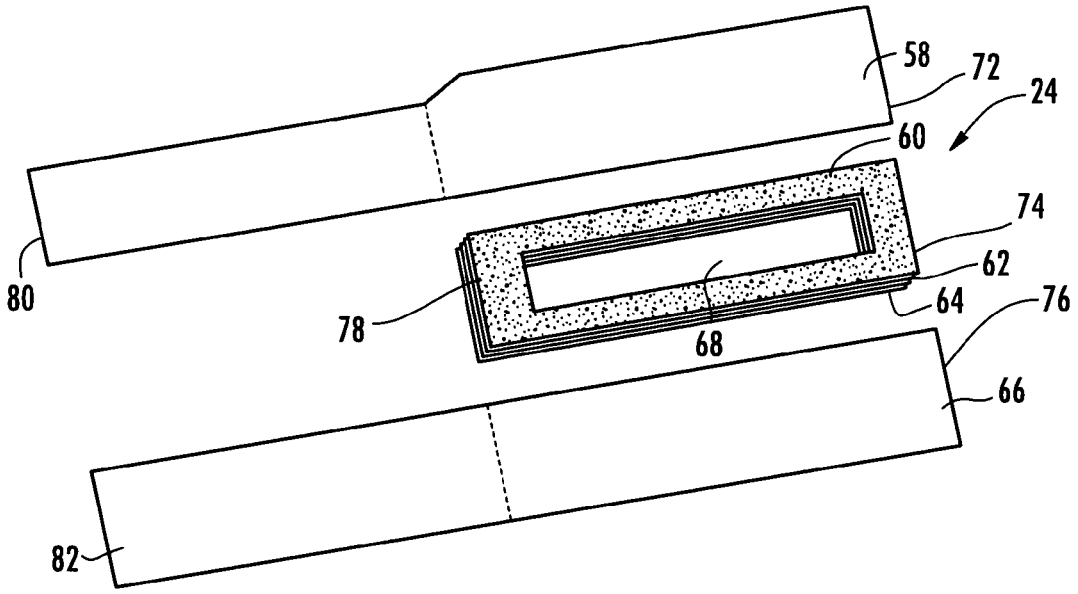
FIG. 3 is an exploded view of a seal for use with the sealing methods according to the disclosure.

Seal—The disclosure preferably includes the use of a toner opening port seal 24 shown in FIG. 3. The seal 24 preferably includes a first pull tab 58, a first adhesive 60, a seal frame 62, a second adhesive 64, and a second pull tab 66. The first pull tab 58, the seal frame 62, and the second pull tab 66 are preferably aligned on their respective ends 72, 74, and 76. The first pull tab 58 preferably comprises a sheet of sealing material made of plastic. A portion of the first pull tab 58 is preferably attached to the seal frame 62 using the first adhesive 60, which is preferably a hot melt adhesive. Hot melt adhesives bind objects together once they are subjected to a certain high environmental temperature. Once activated, hot melt adhesives continue to bind objects together even when the objects and the adhesives are no longer under high environmental temperature. The objects generally adhere together until the hot melt adhesive is exposed to ambient air. The hot melt adhesive usually gets exposed to ambient air when the objects are pulled apart from each other under ambient conditions. Hot melt adhesives are well known in the art and may be obtained from 3M Company of Saint Paul, Minn.

The seal frame 62 is preferably made of a sheet of material that is more rigid than the first and second pull tabs. The seal frame 62 may also be made of plastic and preferably defines a seal frame window 68. The seal frame window 68 is preferably covered by the first pull tab 58 when the seal frame 62 and the first pull tab 58 are attached using the hot melt adhesive. The seal frame 62 is preferably configured to be positioned around the toner opening port such that the seal frame 62 surrounds the printer cartridge portion that defines the toner opening port, and the seal frame window 68 maintains the opening of the toner opening port. The first pull tab 58 that is attached to the seal frame 62 is preferably configured to cover the toner opening port prior to the use of the cartridge.

The seal frame 62 preferably includes a second adhesive 64, which is positioned on the surface of the seal frame 62 that is opposite to the seal frame surface where the first adhesive 60 is positioned. The second adhesive 64 is preferably made of different adhesive than the first adhesive 60. The second adhesive 64 may be a pressure sensitive adhesive, which may be obtained from 3M Company of Saint Paul, Minn. The second adhesive 64 is preferably configured to attach the second pull tab 66 to the seal frame 62.

The second pull tab 66 is preferably a sheet of material, such as paper, designed to prevent premature exposure of the second adhesive 64. The second adhesive 64 is preferably only exposed when the seal 24 is properly positioned around the toner opening port and ready to be attached to the printer cartridge. The second adhesive 64 is preferably exposed by detaching the second pull tab 66 from the seal frame 62 after the seal frame 62 has been inserted to the printer cartridge and the seal frame window 68 is aligned with the toner opening port. When the second pull tab 66 is detached from the seal frame 62, the second adhesive 64 preferably allows the seal frame 62 to adhere to the printer cartridge portion that defines the toner opening port. The seal clamp 20 may be used to press onto the seal frame 62 to allow the second adhesive 64 to attach the seal frame 62 uniformly and effectively to the printer cartridge.

Figure 4:
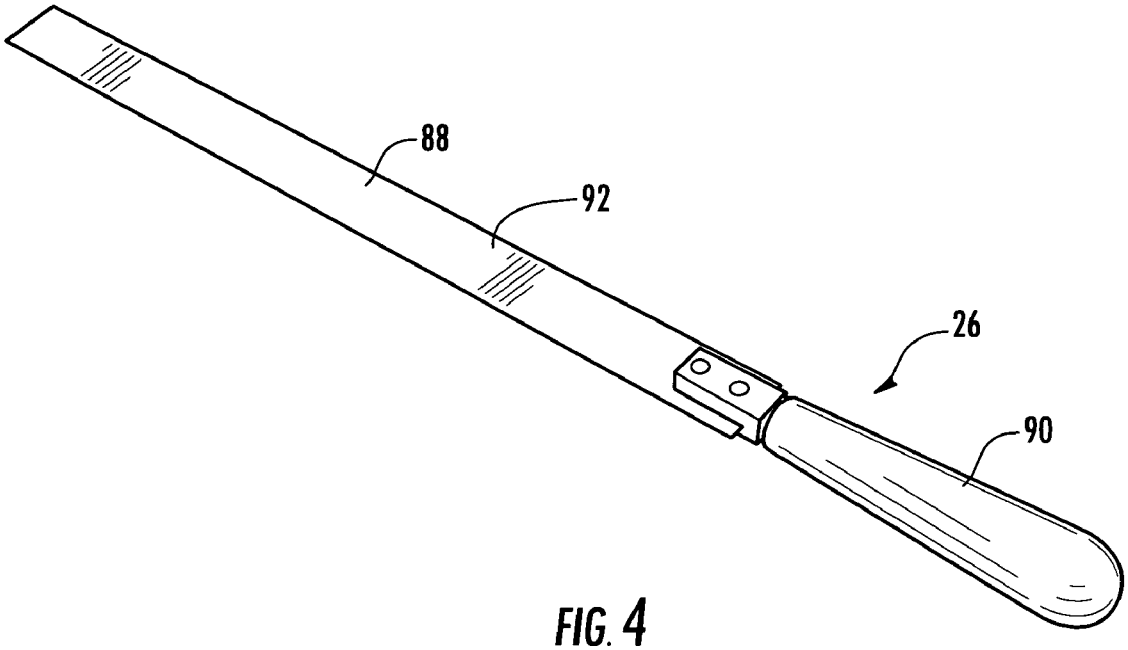
FIG. 4 is a perspective view of a seal insertion tool according to the disclosure.

Seal Insertion Tool—Disclosed embodiments may include the use of a seal insertion tool 26 to aid in the insertion of the seal through the toner exit port 25. Referring now to FIG. 4, seal insertion tool 26 preferably includes a rigid member 88 with a predefined size and shape to fit through the toner exit port (not shown) and within the toner opening port area (not shown). The rigid member 88 may be made of metal or other materials known in the art. The rigid member 88 preferably has the rigidity needed to push the seal through the toner exit port. Attached to the rigid member 88 is preferably a handle 90, which may be grasped by a user to operate the insertion tool 26.

Figure 5:
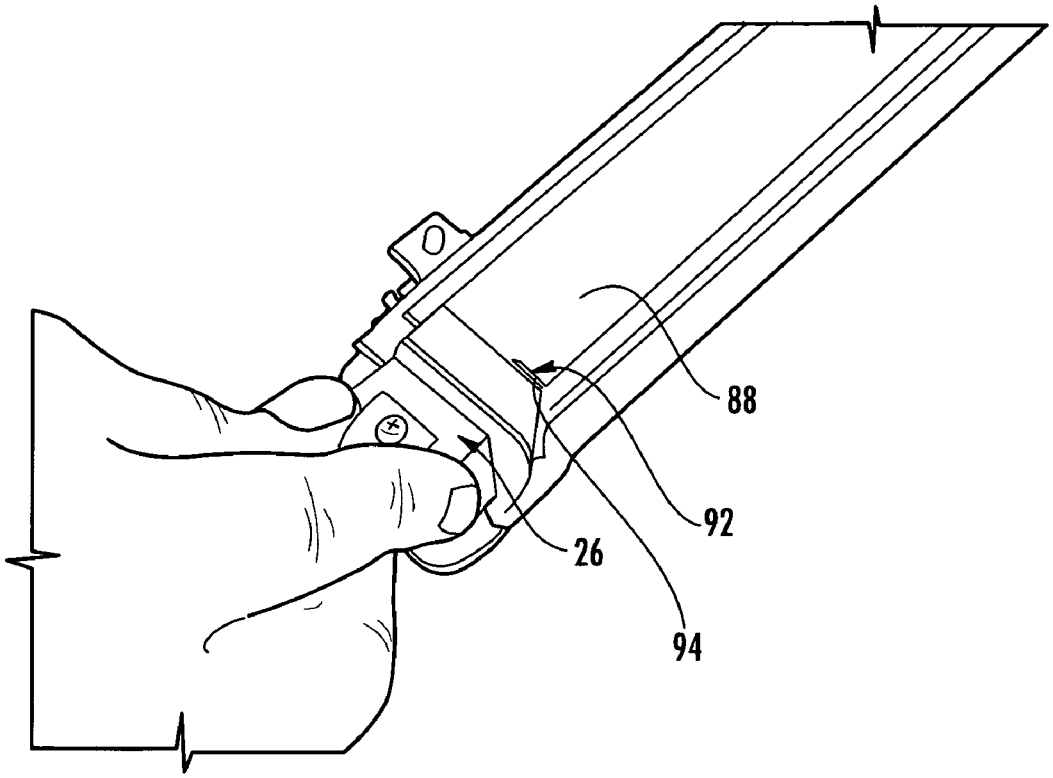
FIG. 5 is a close-up view of the seal insertion tool of FIG. 4.

Referring now to FIG. 5, the rigid member 88 of the seal insertion tool 26 preferably defines a notch 92. The notch 92 is preferably configured to accommodate a known printer cartridge protrusion 94 around the toner opening port, such as a boss, that may push the rigid member 88 up causing the rigid member 88 to sit unevenly on the printer cartridge portion 94 around the toner opening port. It can be appreciated that notch 92 allows the rigid member 88 to sit flush on the printer cartridge so that when the seal clamp 20 is used to apply pressure on the rigid member 88, the rigid member 88 can effectively and evenly press on the seal frame 62 thereby allowing the seal 24 to adhere uniformly well to the printer cartridge 28.

Seal Clamp—One disclosed embodiment preferably includes the use of a seal clamp configured to press onto the seal 24 to promote uniform and effective attachment of the seal to the printer cartridge. Referring back to FIG. 2, the seal clamp 20 is preferably attached to the fixture 22 via a seal clamp mount 44. Seal clamp 20 may be a "hold down action" clamp from De-Sta-Co of Birmingham, Mich. Seal clamp 20 may include a handle 52, a clamp arm 46, a clamp base 54, a first press arm 48, and a second press arm 50. The handle 52 and the clamp arm 46 preferably pivot around each other at the clamp base 54. The clamp arm 46 may be attached to the first press arm 48. The second press arm 50 may be perpendicularly positioned and attached to the first press arm 48.

FIG. 2 shows the handle 52 being at a deactivated position where the handle does not cause the second press arm 50 to exert any pressure or contact the seal. At the deactivated position: the handle 52 may be substantially away from the base 30; the clamp arm 46 and the first press arm 48 may be at an angle that is equal to or more than 90 degrees relative to the side of the base 30 where wall 32*a* is attached; and, the second press arm 50 may be positioned substantially away from the walls 32*a-c* and substantially parallel to the base 30.

The handle 52 may be moved from the deactivated position in FIG. 2 to an activated position by pushing down the handle 52 (see FIG. 1). At the activated position: the handle 52 preferably causes the second press arm 50 to exert pressure and contact the seal; the handle 52 is preferably closer to the base 30 than when at the deactivated position; the clamp arm 46 and the first press arm 48 are preferably less than 90 degrees relative to the base 30; and the second press arm 50 may be substantially perpendicular to the base 30. It can be appreciated that the seal clamp of the disclosure provides a substantially uniform sealing pressure to cause substantially all the surfaces of the seal that is in contact with the printer cartridge to adhere well to the printer cartridge.

Figure 6:
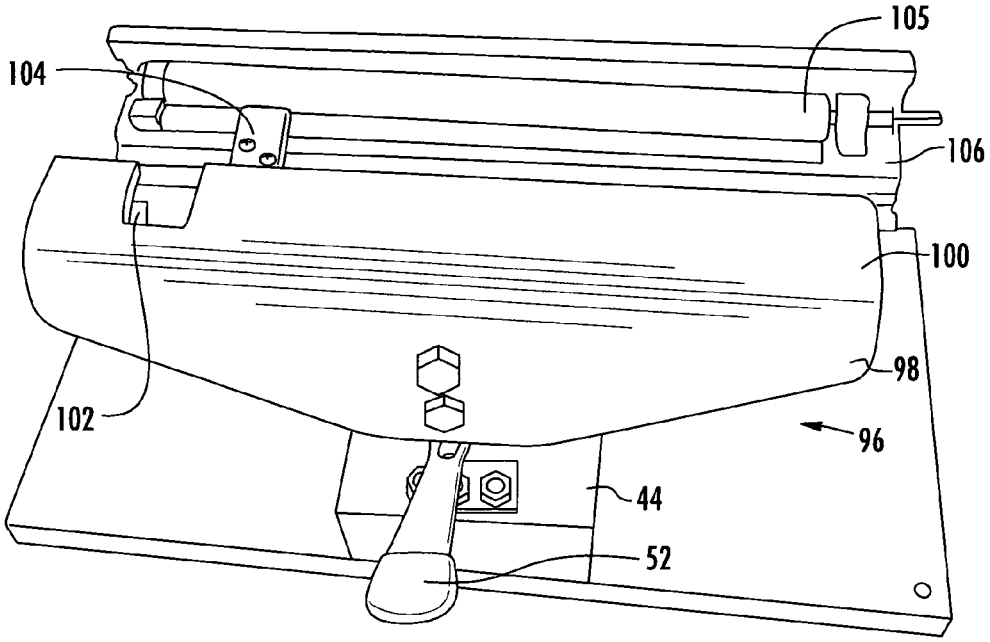
FIG. 6 is a perspective view of another embodiment of a seal clamp according to the disclosure.

Referring now to FIG. 6, another embodiment 96 of a seal clamp is shown wherein, like seal clamp embodiment 20, seal clamp embodiment 96 is also mounted to the seal clamp mount 44. Seal clamp embodiment 96 also includes the same handle 52 and clamp arm (not shown). The differences between the seal clamp embodiment 96 and the seal clamp embodiment 20 are the design of their respective first press arm and second press arm. Specifically, the first press arm 98 and the second press arm 100 of the seal clamp embodiment 96 are part of a single plate that is curved to define the first press arm 98 and the second press arm 100. The first press arm 98 preferably defines a plane to which the plane defined by the second press arm 100 is substantially perpendicularly positioned. The second press arm 100 preferably defines a guide notch 102 to accommodate a seal guide 104. When the handle 52 is moved to an activated position, the second press arm 100 preferably gets inserted between an ad roller 105 and a cartridge portion 106 to contact the seal 24 and the seal insertion tool 26 (not shown in FIG. 3). For purposes of this application, the ad roller and the toner supply roller refer to the same type of roller. The guide notch 102 preferably allows the second press arm 100 to accommodate the seal guide 104 to reach the seal and the seal insertion tool 26.

Figure 7:
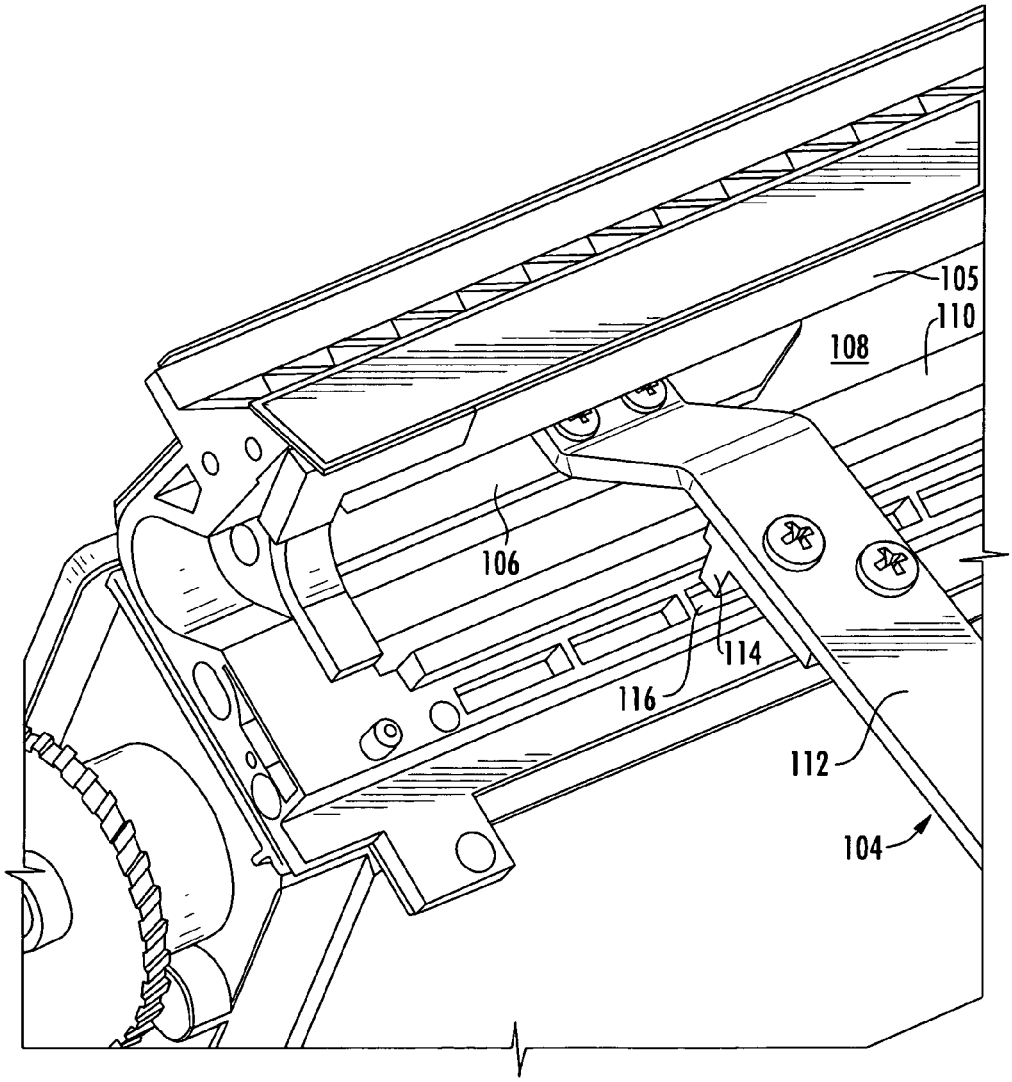
FIG. 7 is a perspective view of a seal guide according to the disclosure.

Referring now to FIG. 7, the seal guide 104 may include a leveler portion 108 configured to be positioned on the corner of cartridge portion 106 that defines the toner opening port 110. The leveler portion 108 is preferably a flat piece of material, such as metal, and is preferably designed to press the seal 24 against the cartridge portion 106 so that the seal 24 may be efficiently attached to the cartridge portion 106 and effectively prevent toner leakage. A seal guide handle 112 may be attached to the leveler portion 108. A guide lock 114 may be provided below the guide handle 112 and may be designed to fit within one of the depressions 116 of the printer cartridge 28. The leveler portion 108 may be inserted under the ad roller 105, positioned on the corner of the cartridge portion 106, and locked by allowing the guide lock 114 to fit inside the depression 116.

Figure 8:
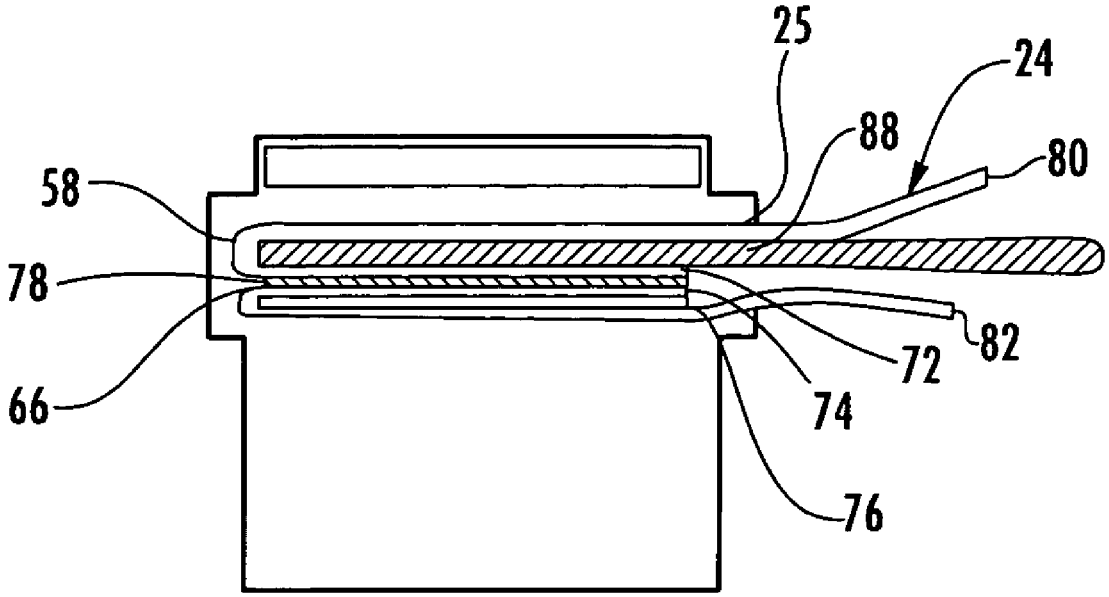
FIG. 8 is a perspective cross-sectional view of a seal being inserted through a toner exit port using one of the embodiments of a toner opening port sealing method according to the disclosure.

Sealing Methods—Referring now to FIG. 8, seal 24 is preferably configured to be inserted through the toner exit port 25 of the printer cartridge. Rigid member 88 of the seal insertion tool 26 is preferably aligned with seal frame end 78. First pull tab 58 is preferably folded over insertion tool 26 such that a portion of the first pull tab 58 is positioned on top of the rigid member 88 insertion tool 26 and first pull tab end 80 exits toner exit port 25. Second pull tab 66 is preferably folded back such that the second pull tab end 82 is allowed to exit the toner exit port 25.

The insertion tool 26 and the seal 24 are preferably inserted through the toner exit port 25 and to the toner opening port area until they reach the end of the toner opening port area. The second pull tab 66 may then be detached from the seal frame 62 by pulling the second pull tab end 82 away from the printer cartridge. The detachment of the second pull tab 66 from the seal frame 62 exposes the second adhesive 64. The seal clamp 20 or 96 may then be used to uniformly press on the seal 24 and the seal insertion tool 26 to allow the second adhesive 64 to effectively attach the seal frame 62 to the printer cartridge 28. It is noted that the seal clamp 20 or 96 may be activated with or without the seal insertion tool 26 inside the printer cartridge.

The seal clamp 20 may be activated by pushing the handle 52, which preferably causes the second clamp arm 50 to pass through the toner adder roller (not shown) and the printer cartridge plastic (not shown). The second clamp arm 50 preferably contacts the first pull tab 58 and preferably applies pressure on the first pull tab 58, the seal insertion tool 26, the seal frame 62, and the second adhesive 64. It can be appreciated that the second clamp arm 50 provides substantially uniform pressure throughout its length and throughout the length of the rigid member 88 of the seal insertion tool 26.

In the alternative embodiment, seal clamp 96 and seal guide 104 may be used. The leveler portion 108 of the seal guide 104 may be inserted under the ad roller 105. The leveler portion 108 may be positioned on the corner of the cartridge portion 106 that defines the toner opening port and locked in place by allowing the guide lock 114 to fit inside the depression 116. The handle 52 of the seal clamp 96 may then be moved from the deactivated position to the activated position. The second press arm 100 may be allowed to go in between the ad roller 105 and the printer cartridge portion 106 with the guide notch 102 being able to accommodate the seal guide 104. The second press arm 100 may provide substantially uniform pressure throughout its length and throughout the length of the rigid member 88 of the seal insertion tool 26. The second press arm 100 may further provide the same pressure to the seal guide 104.

Figure 9:
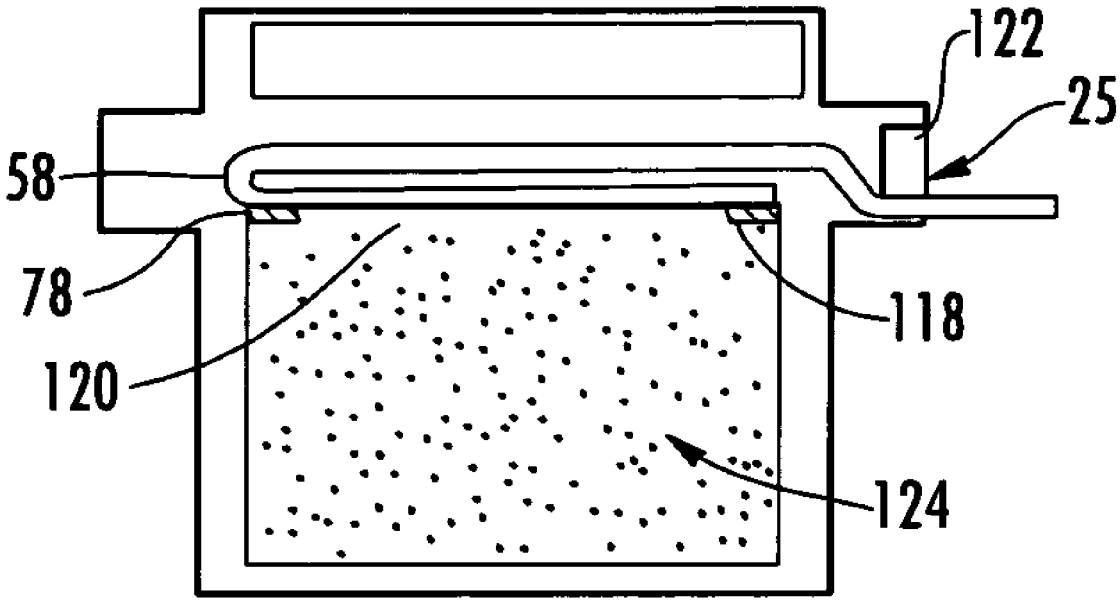
FIG. 9 is a perspective cross-sectional view of a seal having been attached to a printer cartridge around a toner port opening.

Referring now to FIG. 9, after the seal frame end 78 is attached to the printer cartridge portion 118 surrounding the toner opening port 120, the first pull tab 58 is preferably configured to cover the toner opening port 120 until the cartridge is ready to be used. When the cartridge is ready to be used, the first pull tab 58 is configured to be detached from the cartridge to open the supply of toner 124. When the first pull tab 58 is detached from the cartridge, it goes through the toner exit port 25. The toner exit port 25 is typically covered by a toner exit port plug 122 to prevent toner leakage around the toner exit port 25. As the first pull tab 58 is pulled away from the seal frame end 78, the heat seal adhesive gets exposed to ambient air and gets deactivated. The first pull tab 58 substantially loses its ability to stick to the seal frame end 78 or adhere to any surface, including the toner exit port plug 122. It can be realized that when the first pull tab 58 passes through the toner exit port 25 and the toner exit port plug 122, the first pull tab 58 may not substantially adhere to the toner exit port plug 122. The heat sensitive adhesive helps prevent the first pull tab 58 from displacing the toner exit port plug 122, and thus helps prevent the toner from leaking around the toner exit port 25.

Figure 10:
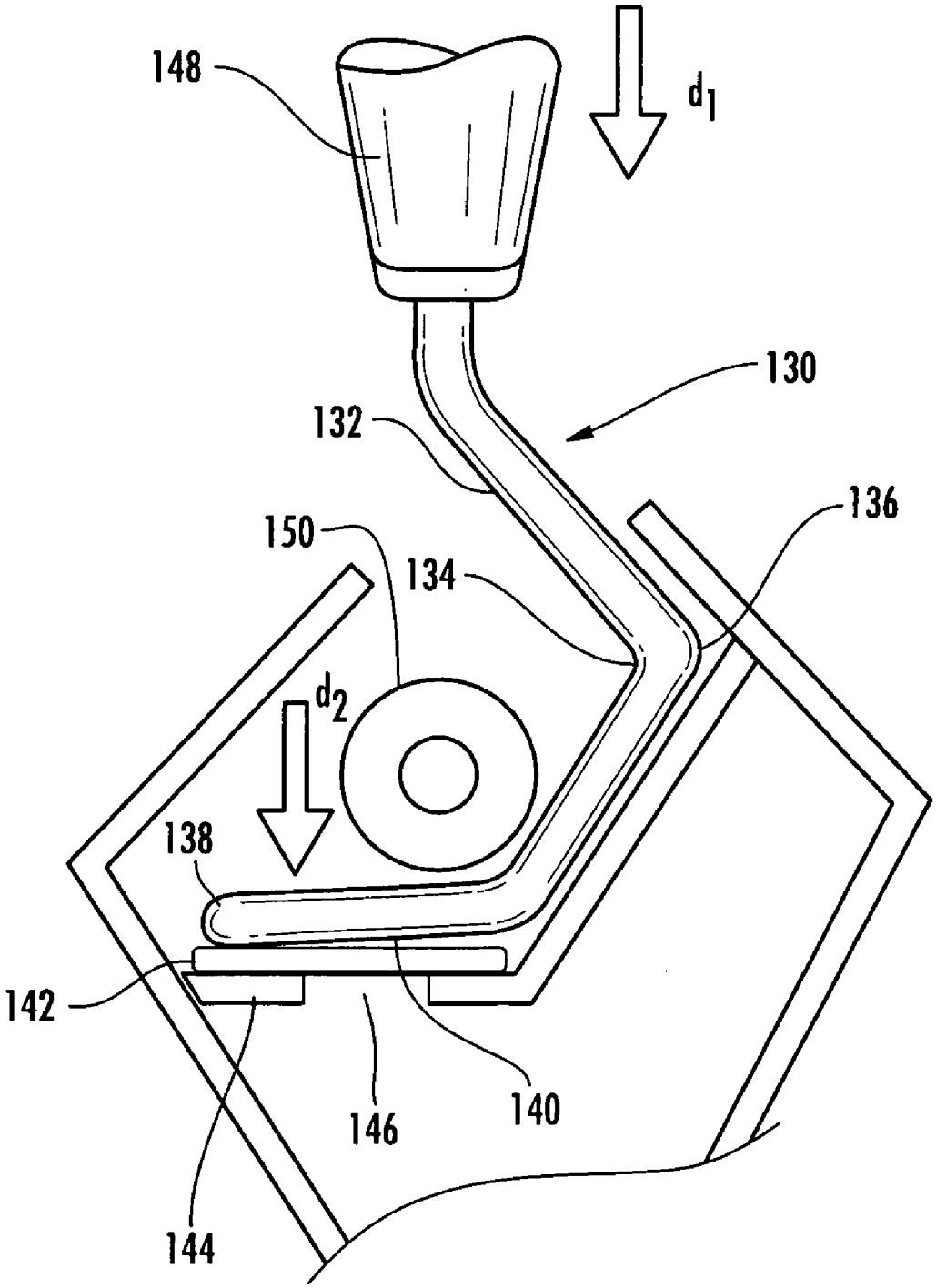
FIG. 10 is a perspective cross-sectional view of a printer cartridge portion with a printer cartridge seal applicator according to the disclosure being used to promote adhesion of a seal to the printer cartridge portion defining a toner opening port.

Seal Applicators—The disclosure also provides for a first embodiment of a seal applicator 130 shown in FIG. 10. Seal applicator 130 preferably includes a curved body 132 having a concave side 134 and a convex side 136. Seal applicator 130 preferably also includes an applicator end 138 connected to the curved body 132 and a handle 148 connected to the opposite end. The handle 148 may be in a form of an extension member of the curved body 132 and may be made of a material different from the material of the curved body 132. The handle 148 may also be cylindrical in shape.

Figure 11:
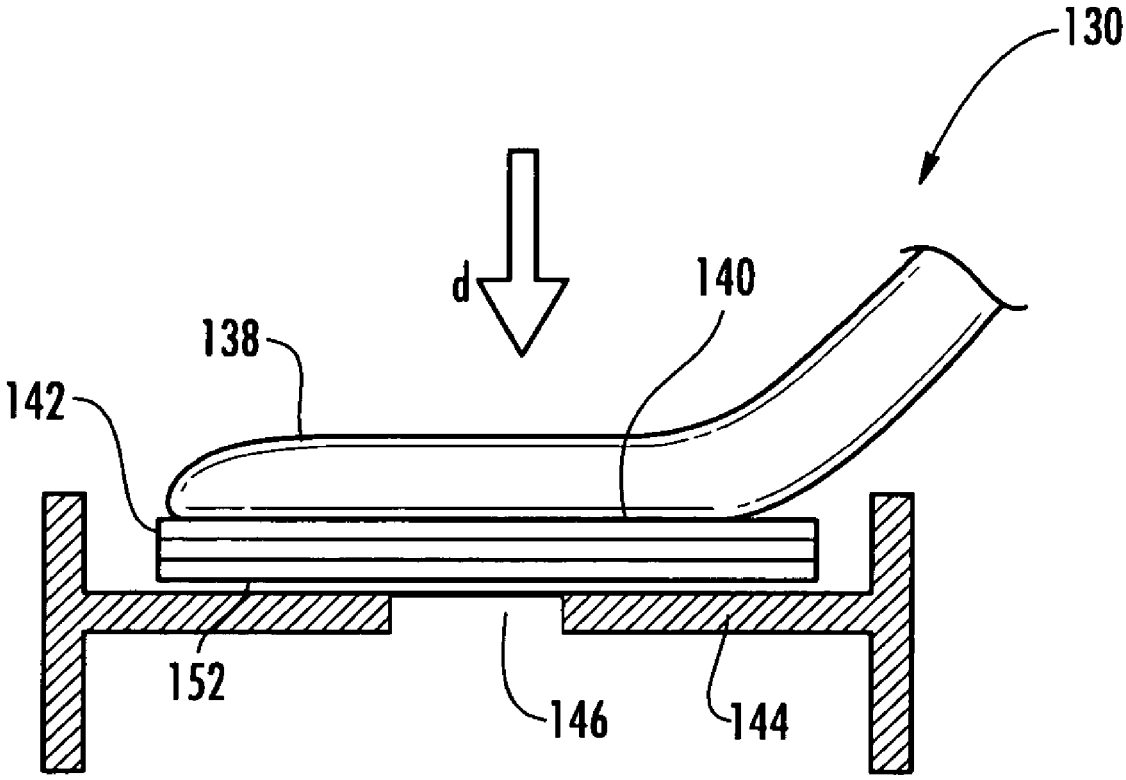
FIG. 11 is a close up view of the printer cartridge seal applicator, the seal, and the toner opening port of FIG. 10.

The curved body 132 may allow a user holding the seal applicator 130 from the handle 148 to insert the applicator end 138 in between a toner supply roller 150 and the seal 142 without having to detach the toner supply roller 150 from the printer cartridge. The concave side 134 of the curved body 132 may accommodate the toner supply roller 150 when inserting the applicator end 138 in between the toner supply roller 150 and the seal 142. The applicator end 138 preferably includes a bottom surface 140 connected to the periphery of the convex side 136 of the curved body 132. Referring now to FIG. 11, the bottom surface 140 is preferably substantially flat relative to the ground, and is preferably configured to be used to press a seal 142 against a printer cartridge portion 144 defining the toner opening port 146. The user may push down on the handle 148 to allow the bottom surface 140 to press the seal 142 against the printer cartridge portion 144 defining the toner opening port 146 to promote the adhesion of the seal adhesive 152 to the printer cartridge portion 144.

Figure 12:
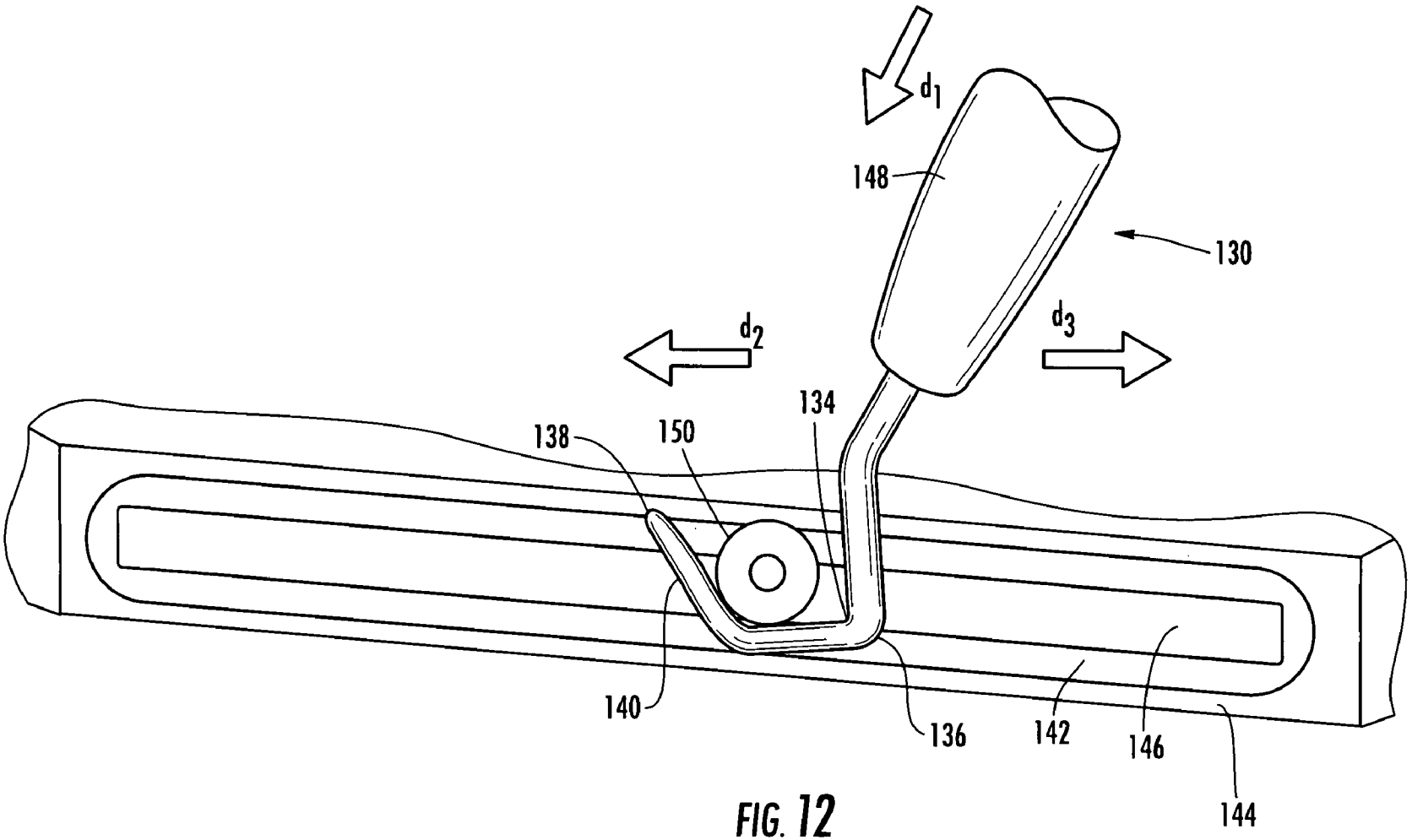
FIG. 12 is a perspective view of the printer cartridge seal applicator of FIG. 10 being used to promote adhesion of substantially an entire length of the seal.

Referring now to FIG. 12, the seal applicator 130 may be moved within the cartridge using the handle 148 once the applicator end 138 is positioned in between the toner supply roller 150 and the seal 142. By moving the seal applicator 130 within the cartridge and pushing the seal applicator 130 against the cartridge, the adhesion of the seal 142 to the printer cartridge portion 144 defining the toner opening port 146 is promoted throughout the length of the seal 142. It can be appreciated that the design of the curved body 132 allows for the easy insertion of the applicator end 138 through the toner supply roller 150 and printer cartridge wall 144. It can further be appreciated that the design of the curved body 132 saves remanufacturers from having to disassemble the printer cartridge components in order to press the seal against the printer cartridge and promote seal adhesion of the seal to the printer cartridge.

Figure 13:
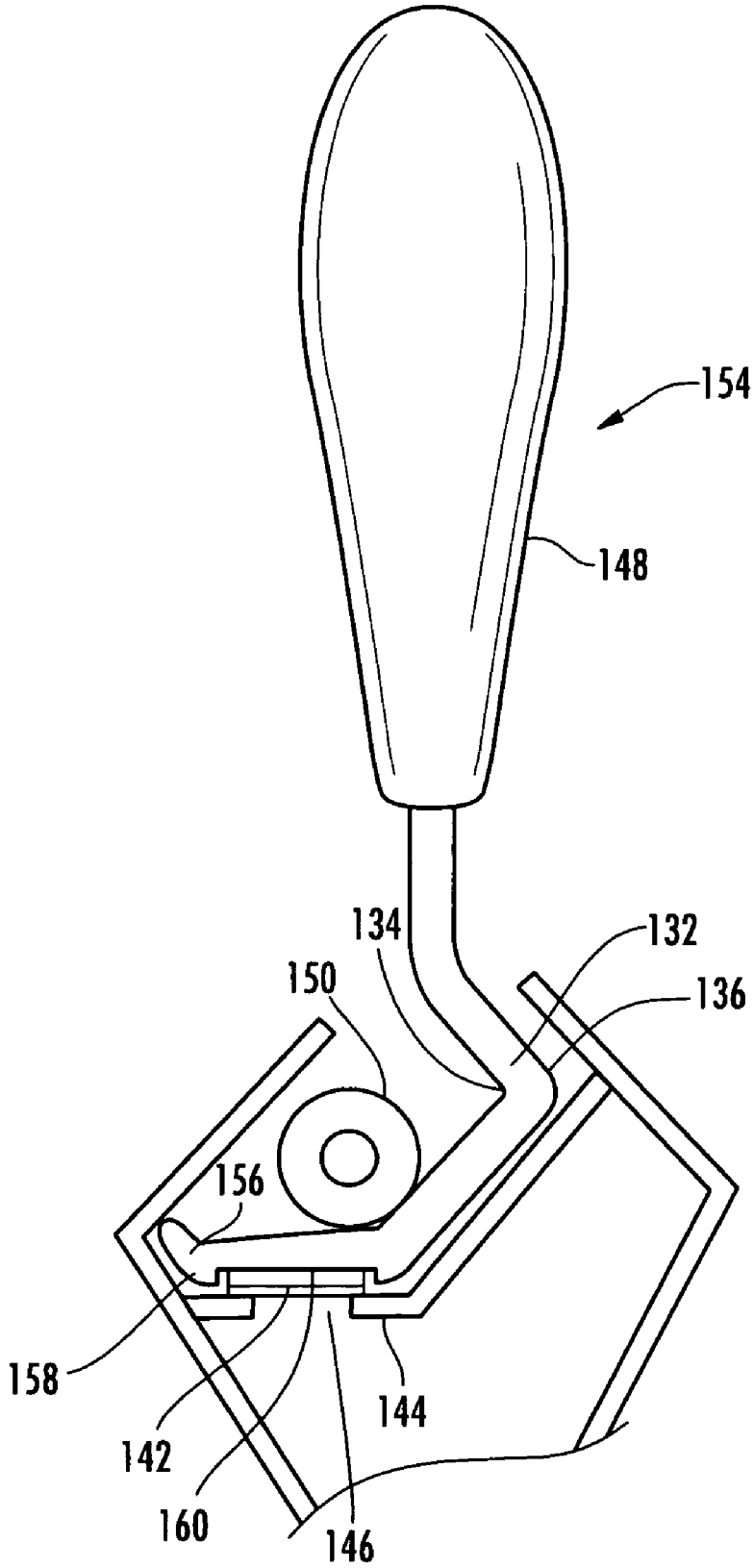
FIG. 13 is a perspective cross-sectional view of a printer cartridge portion with another embodiment of a printer cartridge seal applicator according to the disclosure.

Referring now to FIG. 13, the disclosed embodiments also include a second embodiment of a seal applicator 154. Like seal applicator 130, the second embodiment 154 preferably also includes the same handle 148, curved body 132, concave side 134 of the curved body 132, and the convex side 136 of the curved body 132. The second embodiment of the seal applicator 154 preferably includes a different applicator end 156. Applicator end 156 preferably has a bottom surface 158 that defines a notch 160 that is sized to accommodate a seal pull strip.

Figure 14:
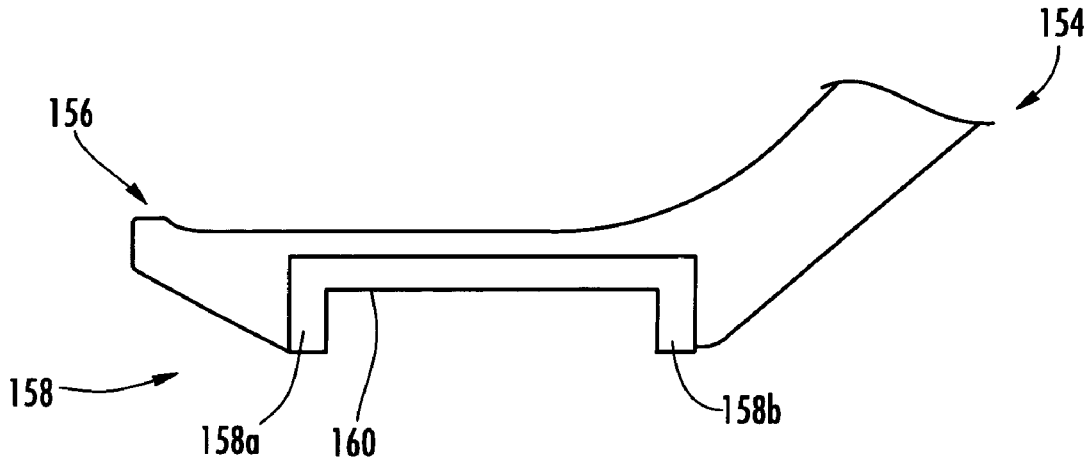
FIG. 14 is a side view of an applicator portion of the printer cartridge seal applicator of FIG. 13.
Figure 15:
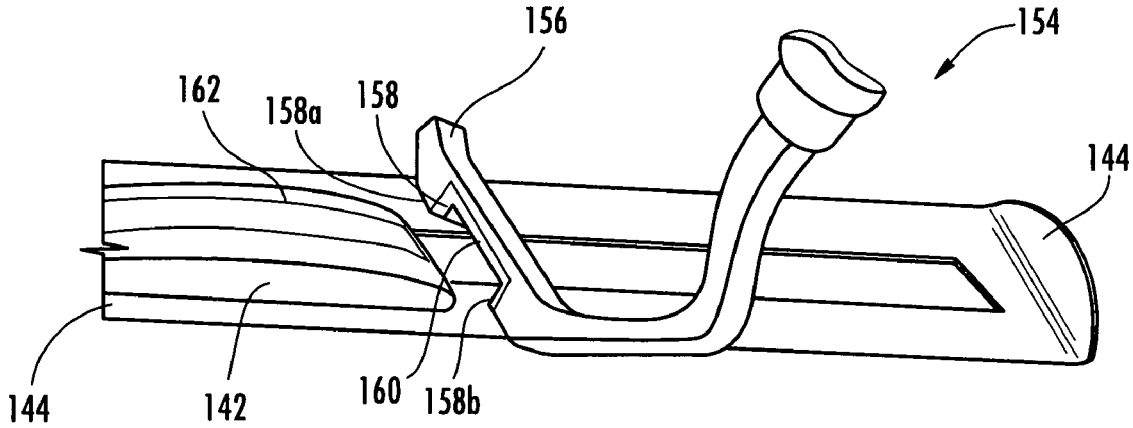
FIG. 15 is a perspective view of the printer cartridge seal applicator of FIG. 13 being used to promote adhesion of substantially an entire length of the seal while accommodating a seal pull strip.

Referring now to FIGS. 14 and 15, the bottom surface 158 of the applicator end 156 is preferably divided into two chamfers 158*a* and 158*b*. In between the two chamfers 158*a* and 158*b* is preferably a notch 160 designed to accommodate a seal pull strip 162. By accommodating the seal pull strip 162, the seal applicator 154 may minimize the likelihood of pulling on the seal pull strip 162 when moving the seal applicator 154 within the printer cartridge, which may compromise the adhesion of a newly installed seal on the printer cartridge.

Each chamfer 158*a* and 158*b* preferably includes a substantially flat bottom configured to press a seal against a printer cartridge portion 144 that defines the toner opening port 146. The notch 160 preferably traverses across the toner opening port. Chamfer 158*a* may press the seal on one side of the toner opening port. Chamfer 158*b* may press the seal on the other side of the toner opening port. Each chamfer 158*a* and 158*b* may include its respective bottom surface that may act as a seal contact surface. The flat bottom of each of the chamfer 158*a* and 158*b* may allow for the seal applicator to be moved with ease within the printer cartridge. It is noted that the chamfer design may be modified and still falls within the scope of the invention. For instance, instead of the chamfer design, the applicator end 156 may have a pair of vertical members defining a notch.

Once the applicator end 156 of the seal applicator 154 is positioned in between the toner supply roller 150 and the seal 142 of a printer cartridge, the user may push down on the handle 148 to allow the applicator end 156 to press the seal 142 against the printer cartridge portion 144. The seal applicator 154 may be moved within the cartridge using the handle 148. By moving the seal applicator 156 within the cartridge, the adhesion of the seal 142 to the printer cartridge portion 144 is promoted throughout the length of the seal 142. The notch 160 preferably prevents the seal pull strip 162 from being snagged by the seal applicator 154, as the seal applicator 154 is moved.

Figure 18:
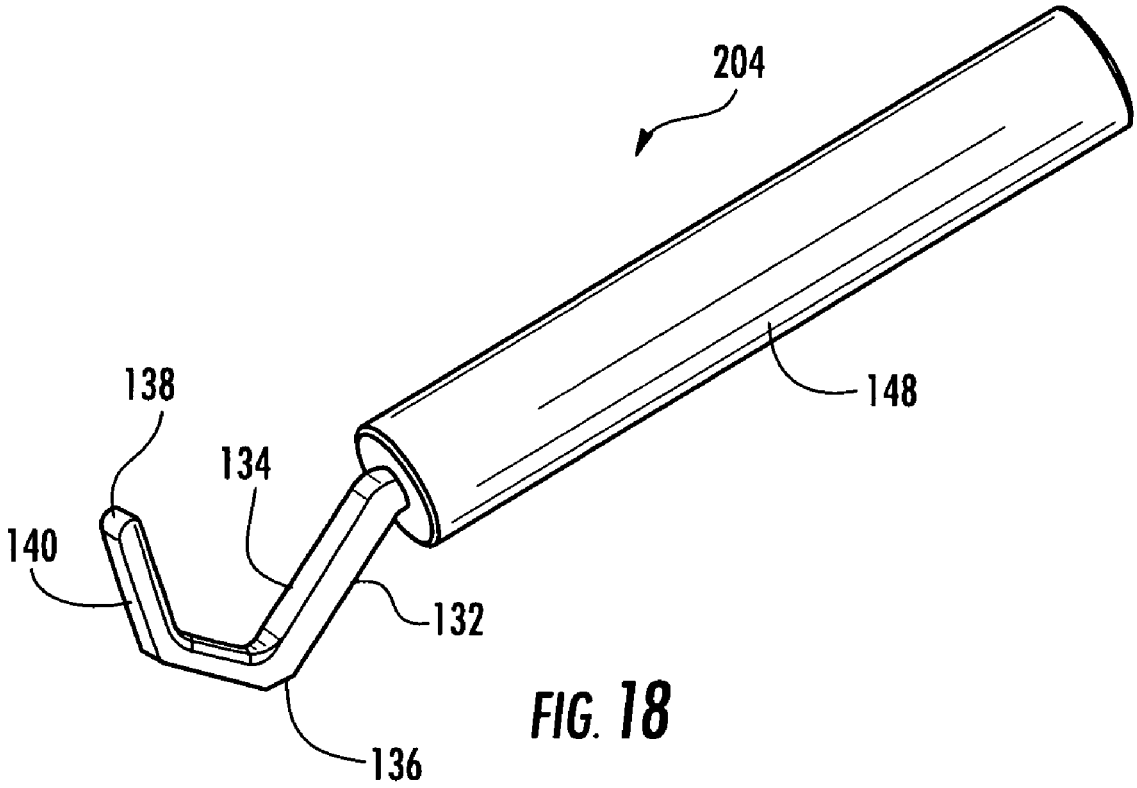
FIG. 18 is perspective view of an embodiment of a printer cartridge seal applicator having a flat applicator portion.
Figure 19:
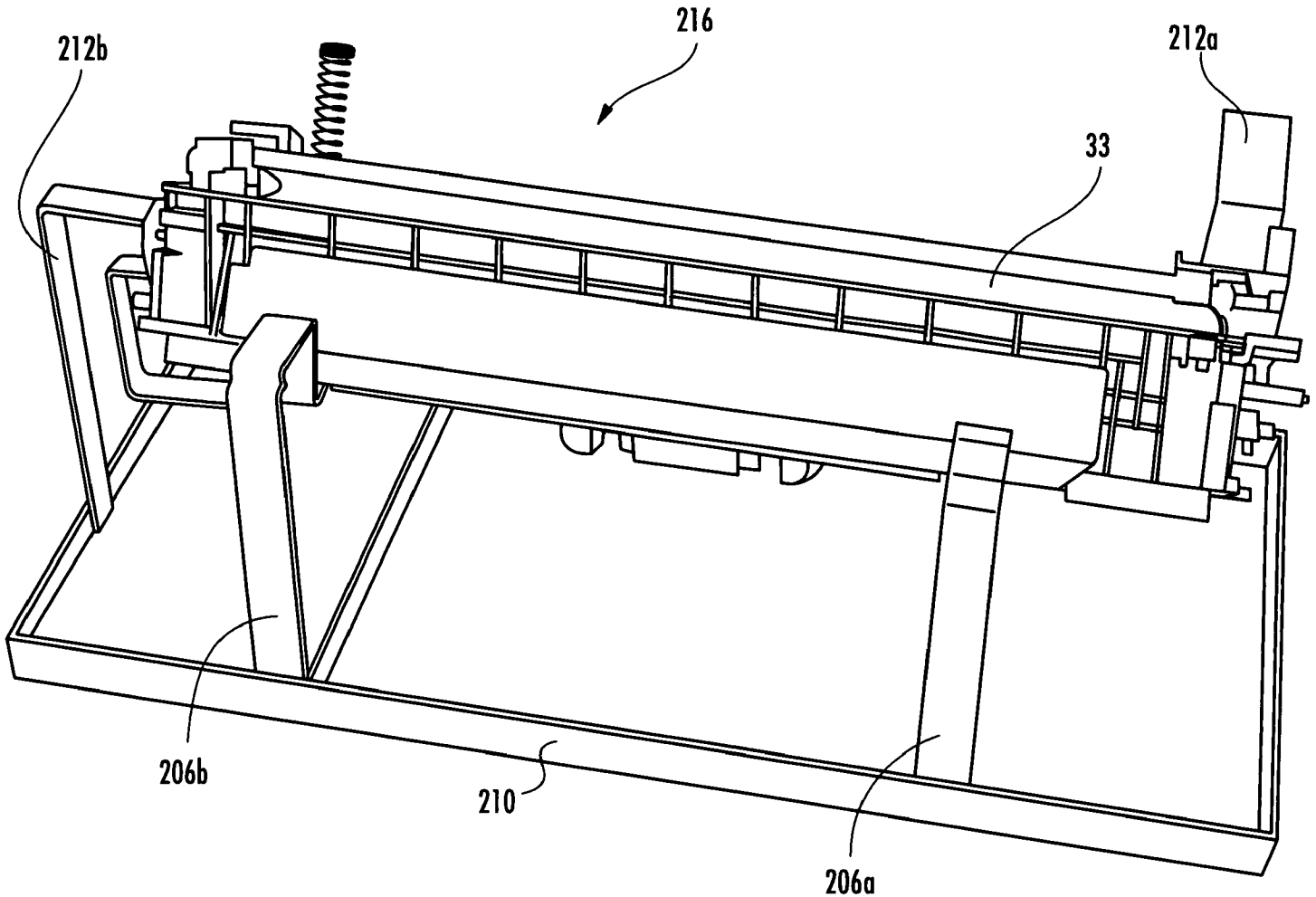
FIG. 19 is a front perspective view of a known printer cartridge positioned on an embodiment of a fixture according to the disclosure.

There is provided in another embodiment a device, such as one of the embodiments 130, 154, 202, or 204 (see FIGS. 10, 13, 17, 18), for promoting adhesion of a printer cartridge seal 142 (see FIG. 20) to a toner hopper 33 of a printer cartridge 216 (see FIG. 19). The device comprises an applicator means, such as one of the embodiments 138, 156, for applying pressure to the printer cartridge seal 142. The applicator means 138 may comprise a bottom surface 140 that is flat. The applicator means 156 may preferably comprise a bottom surface 158 that defines a notch 160. The device further comprises a handle means 148 for positioning the applicator means 138 or 156 in between a toner supply roller 150 and a printer cartridge portion, such as 218 (see FIG. 21), defining a toner opening port 146 (see FIGS. 11 and 13). The handle means 148 is connected to the applicator means 138 or 156.

Figure 16:
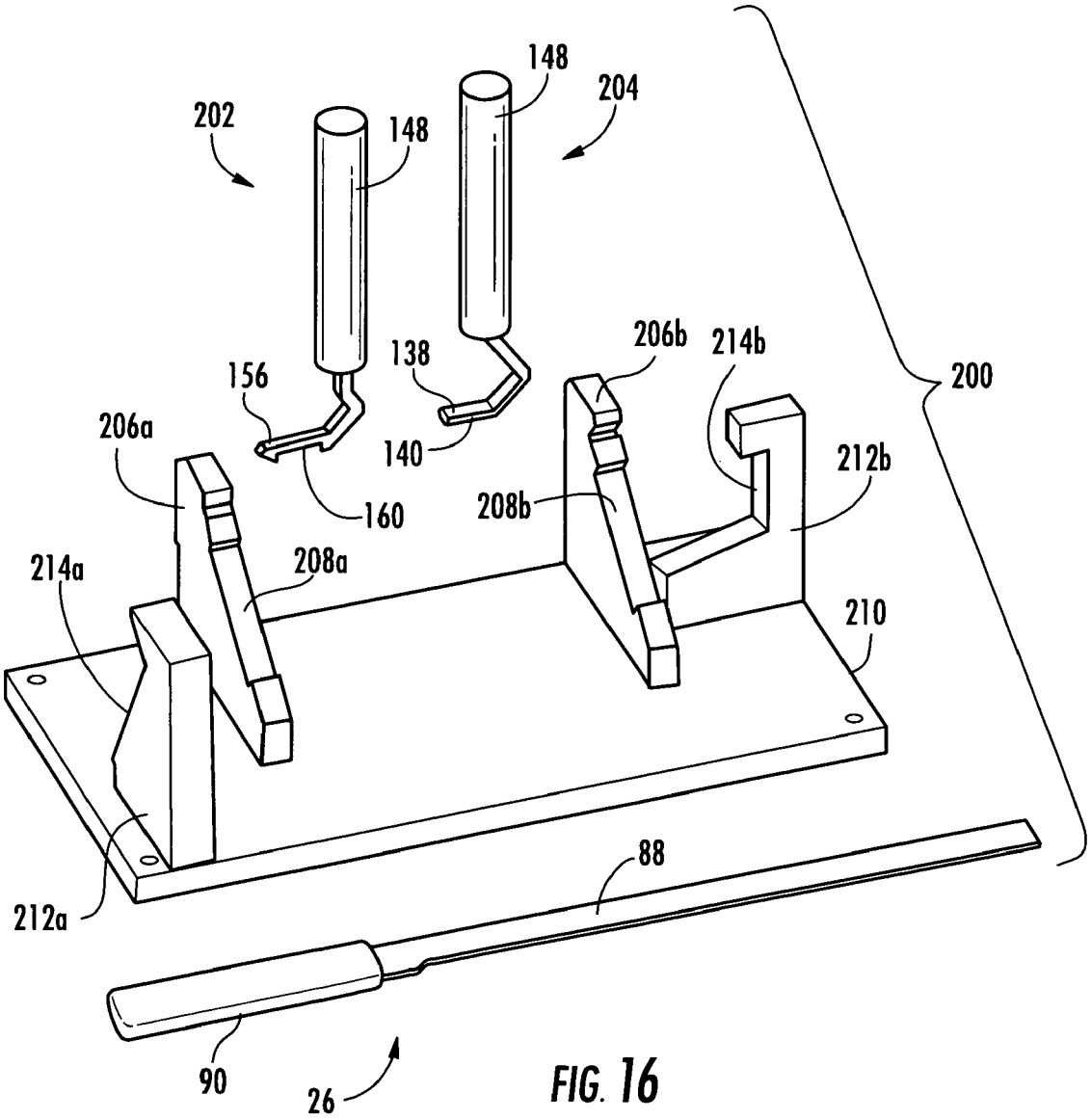
FIG. 16 is an exploded view of one of the embodiments of an assembly for promoting adhesion of a printer cartridge seal according to the disclosure.
Figure 22:
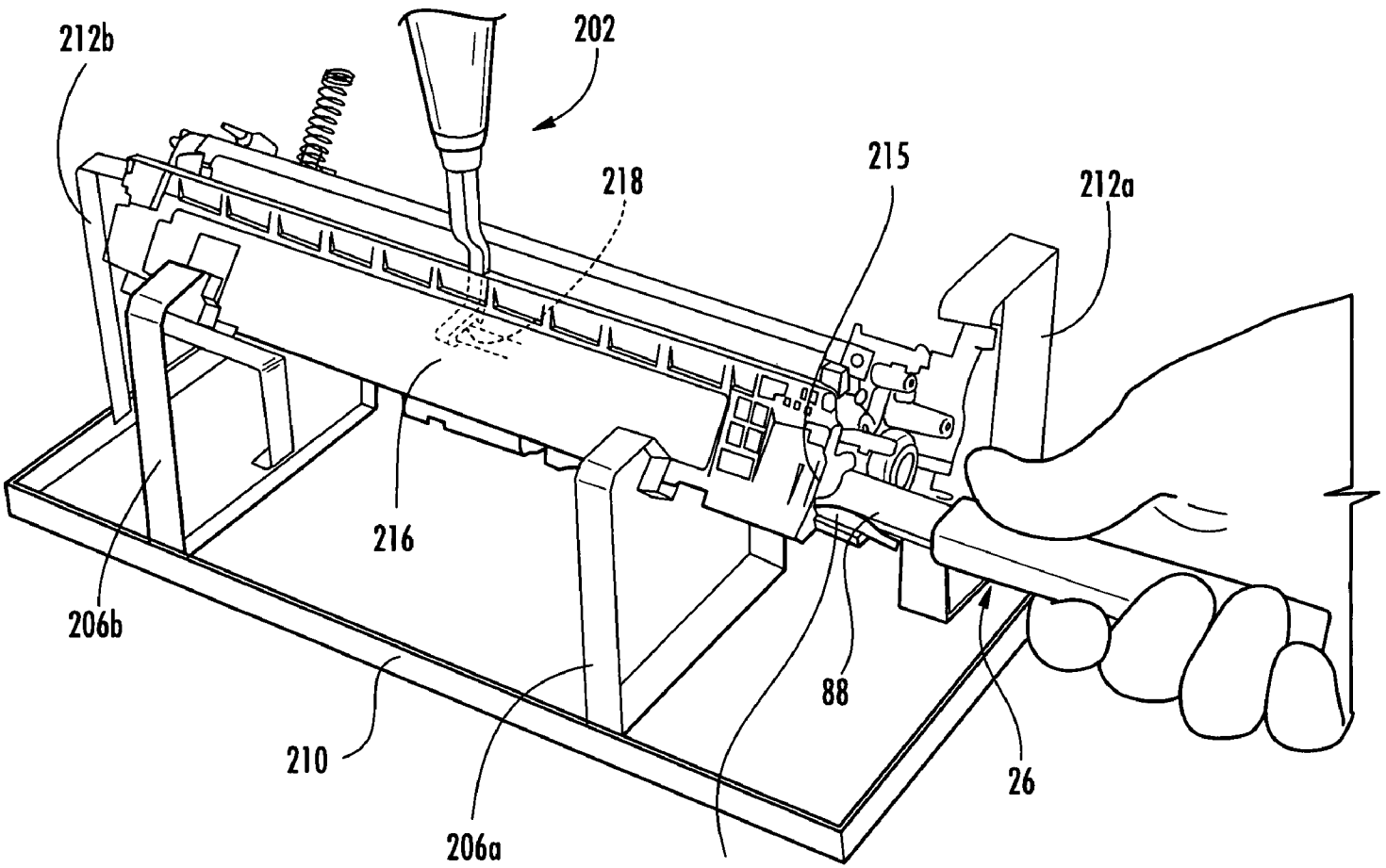
FIG. 22 is a front perspective view of the cartridge and fixture of FIG. 19 with an embodiment of a first printer cartridge seal applicator and an embodiment of a seal insertion tool both inserted in the printer cartridge using one of the embodiments of a toner opening port sealing method according to the disclosure.

FIG. 16 is an exploded view of one of the embodiments of an assembly 200 for promoting adhesion of a printer cartridge seal 142 (see FIG. 20) to a printer cartridge portion that defines a toner opening port 146 (see FIGS. 10 and 13), where the toner opening port 146 is accessible through a toner exit port 215 (see FIG. 22). The assembly 200 comprises a fixture 210 (see FIG. 16) configured to support a printer cartridge 216. FIG. 19 is a front perspective view of a known printer cartridge 216, and in particular, a toner hopper 33 of the printer cartridge 216, positioned on an embodiment of the fixture 210 according to the disclosure. The fixture 210 has a plurality of first walls 206*a*, 206*b* (see FIG. 16) and second walls 212*a*, 212*b* (see FIG. 16) configured to minimize movement of the toner hopper 33 of the printer cartridge 216. The first wall 206*a* has a printer cartridge retaining portion 208*a*. The first wall 206*b* has a printer cartridge retaining portion 208*b*. The second wall 212*a* has a printer cartridge retaining portion 214*a*. The second wall 212*b* has a printer cartridge retaining portion 214*b*.

Figure 17:
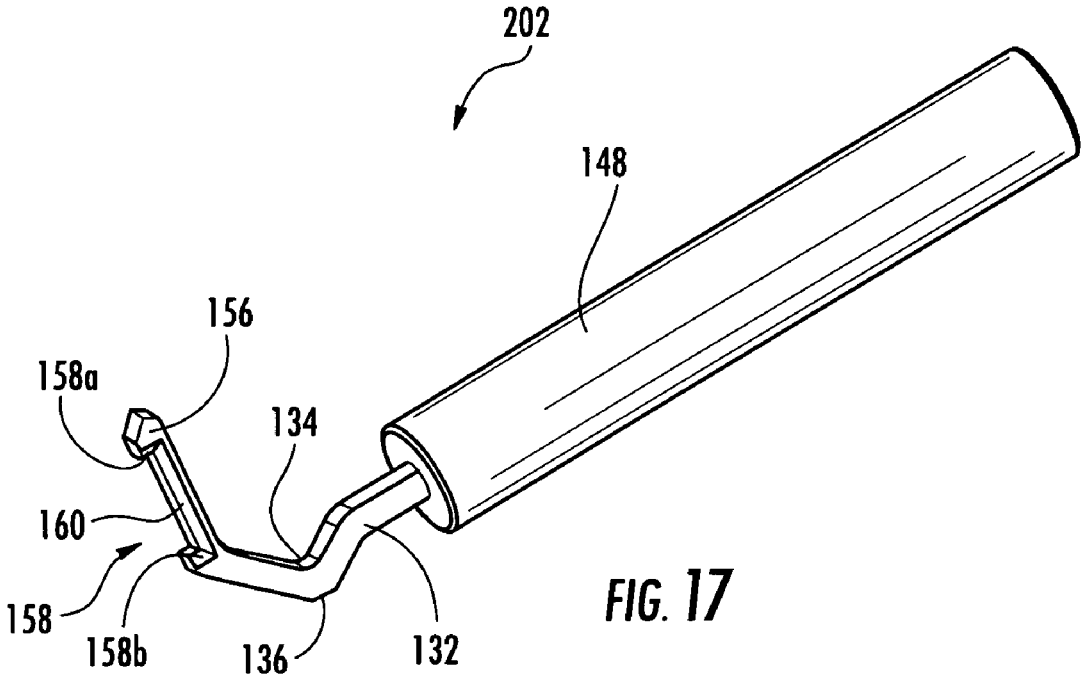
FIG. 17 is perspective view of an embodiment of a printer cartridge seal applicator having a notched applicator portion.

The assembly 200 further comprises a first printer cartridge seal applicator 202 (see FIG. 16). The first printer cartridge applicator 202 has a notched applicator portion 160 configured to accommodate a printer cartridge seal pull strip 162 (see FIG. 15) or adhesive backing, which is part of the printer cartridge seal 142, and also configured to align and press the printer cartridge seal 142 against a first printer cartridge surface 218 (see FIG. 21). FIG. 17 is perspective view of an embodiment of the printer cartridge seal applicator 202 having a notched applicator portion 160. The first printer cartridge seal applicator 202 has an applicator body 132 (see FIG. 13) connected to the notched applicator portion 160. The applicator body 132 preferably comprises a concave side 134 in which a portion of the concave side 134 is configured to be positioned adjacent to a toner supply roller 150 (see FIG. 21). The applicator body 132 further comprises a convex side 136. The notched applicator portion 160 is preferably configured to accommodate a pull strip 162 of the printer cartridge seal 142. The notched applicator portion 160 further comprises a plurality of chamfers 158*a*, 158*b* defining the notch substantially in between the plurality of the chamfers 158*a*, 158*b*. The first printer cartridge seal applicator 202 further comprises a handle 148 (see FIG. 13) connected to the applicator body 132. The handle 148 may be used to position the concave side 134 of the applicator body 132 adjacent to the toner supply roller 150 and position the notched applicator portion 160 in between the toner supply roller 150 and a first printer cartridge surface 218 defining a toner opening port 146 (see FIG. 22).

Figure 20:
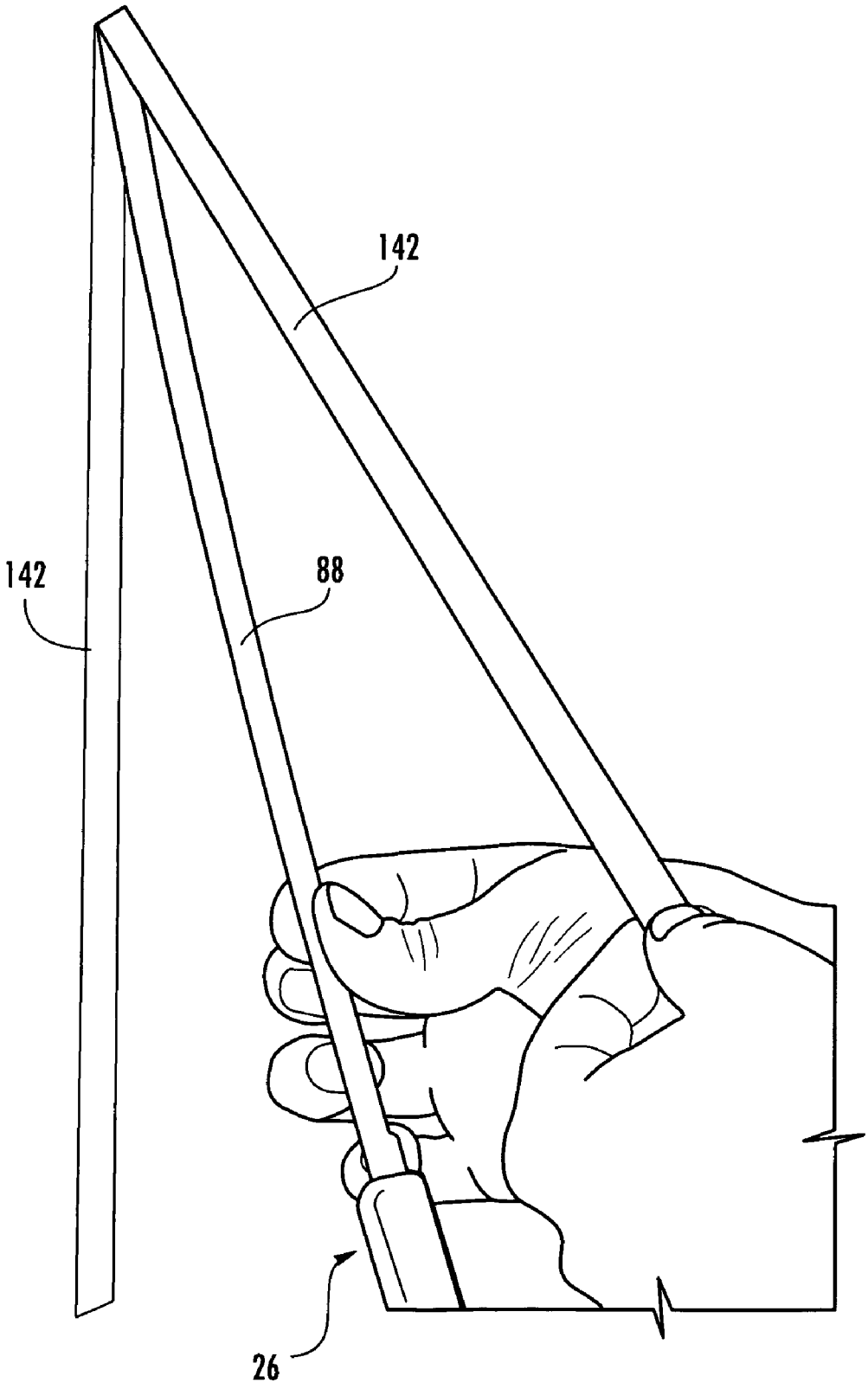
FIG. 20 is a perspective view of a known insertion type seal and an embodiment of a seal insertion tool according to the disclosure.

The assembly 200 further comprises a second printer cartridge seal applicator 204. The second printer cartridge seal applicator 204 has a flat applicator portion 140 configured to apply pressure on or to the printer cartridge seal 142 against a second printer cartridge surface 220 (see FIG. 23) and is configured to press and slide against the printer cartridge seal 142 along a length of the printer cartridge 216, and in particular, a length of the toner hopper 33 of the printer cartridge 216, in order assist in adhering the printer cartridge seal 142 against a length of the toner hopper 33 of the printer cartridge 216. FIG. 18 is perspective view of an embodiment of the printer cartridge seal applicator 204 having a flat applicator portion 140. The second printer cartridge seal applicator 204 has an applicator body 132 (see FIG. 10) connected to the flat applicator portion 140. The applicator body 132 preferably comprises a concave side 134 in which a portion of the concave side 134 is configured to be positioned adjacent to a toner supply roller 150 (see FIG. 21). The flat surface 140 is preferably connected to the convex side 136 of the applicator body 132, and the flat surface 140 is preferably configured to allow the applicator body 132 to slide on the printer cartridge seal 142 to promote adhesion of an adhesive back of the printer cartridge seal 142 along a length of the printer cartridge seal 142 and along a length of the printer cartridge 216, and in particular, along a length of the toner hopper 33 of the printer cartridge 216. The second printer cartridge seal applicator 204 further comprises a handle 148 (see FIG. 10) connected to the applicator body 132. The handle 148 may be used to position the concave side 134 of the applicator body 132 adjacent to the toner supply roller 150 and position the flat applicator portion 140 in between the toner supply roller 150 and a second printer cartridge surface 220 (see FIG. 23). The assembly 200 further comprises a seal insertion tool 26 (see FIGS. 20, 16 and 4) for inserting the printer cartridge seal 142 through the toner exit port 215 (see FIG. 22). FIG. 20 is a perspective view of a known insertion type seal 142 and an embodiment of a seal insertion tool 26 according to the disclosure.

Figure 21:
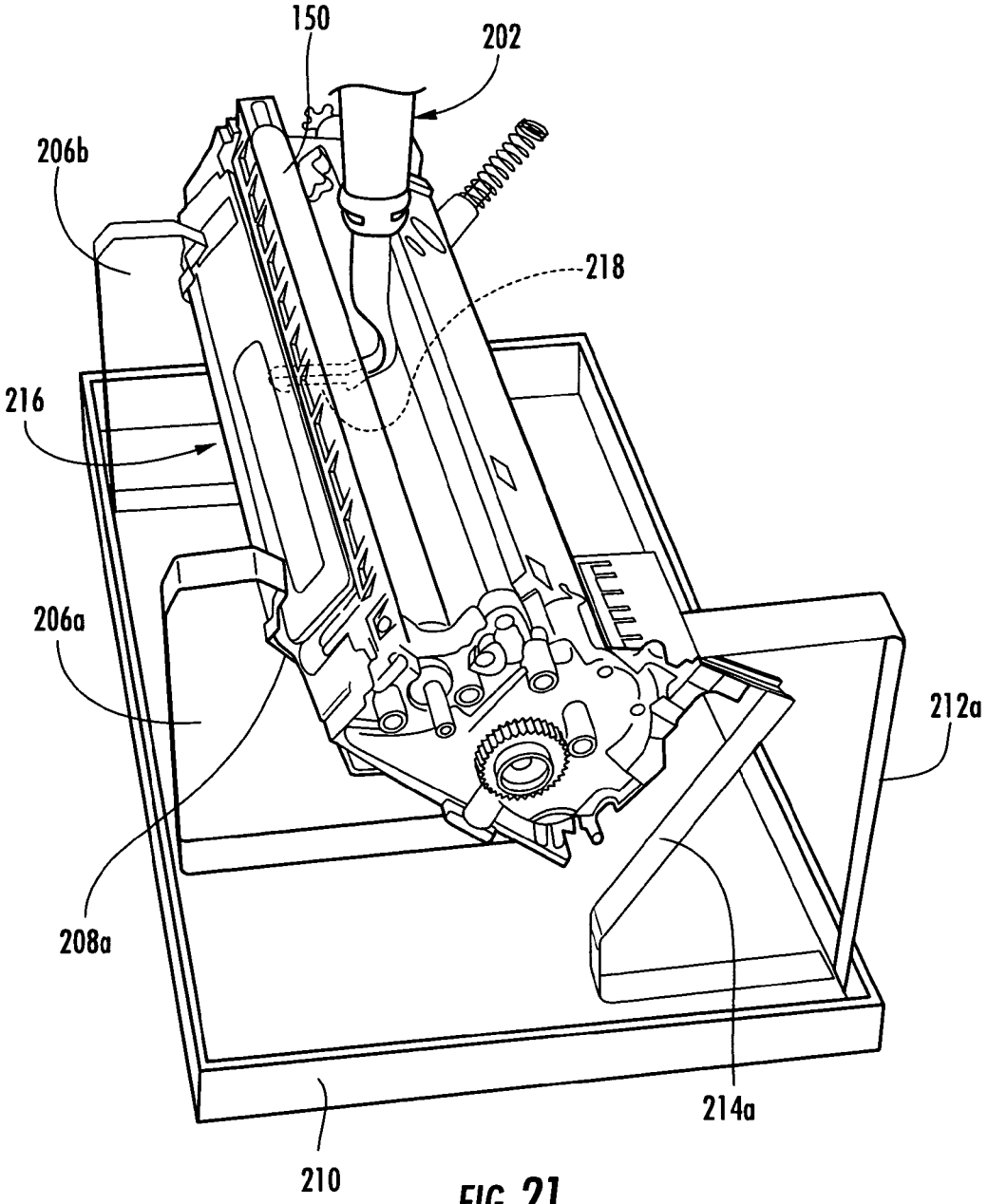
FIG. 21 is a right side perspective view of the cartridge and fixture of FIG. 19 with an embodiment of a first printer cartridge seal applicator inserted in the printer cartridge using one of the embodiments of a toner opening port sealing method according to the disclosure.
Figure 23:
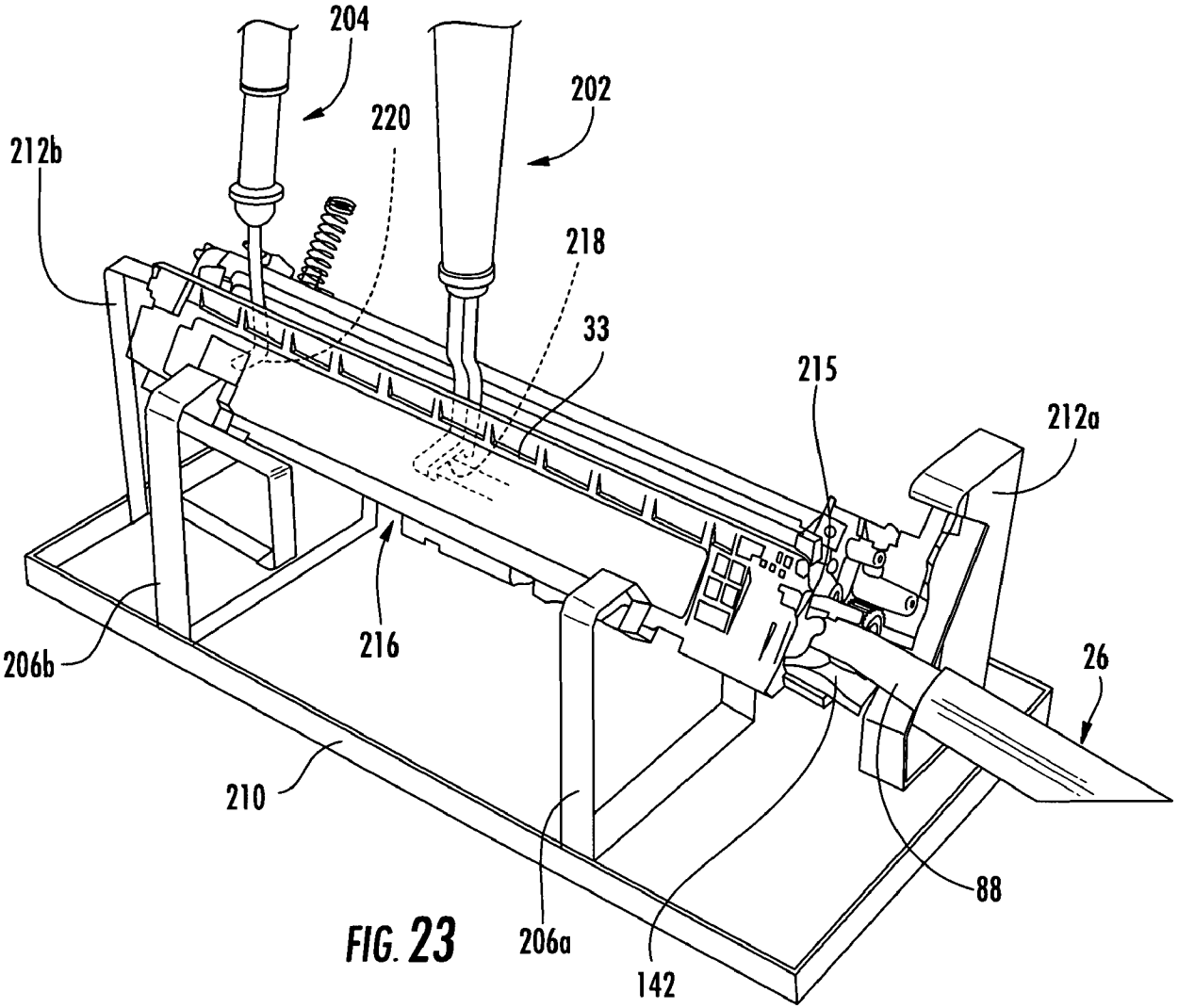
FIG. 23 is a front perspective view of the cartridge and fixture of FIG. 19 with an embodiment of a first printer cartridge seal applicator, an embodiment of a seal insertion tool, and an embodiment of a second printer cartridge seal applicator, all inserted in the printer cartridge using one of the embodiments of a toner opening port sealing method according to the disclosure.
Figure 24:
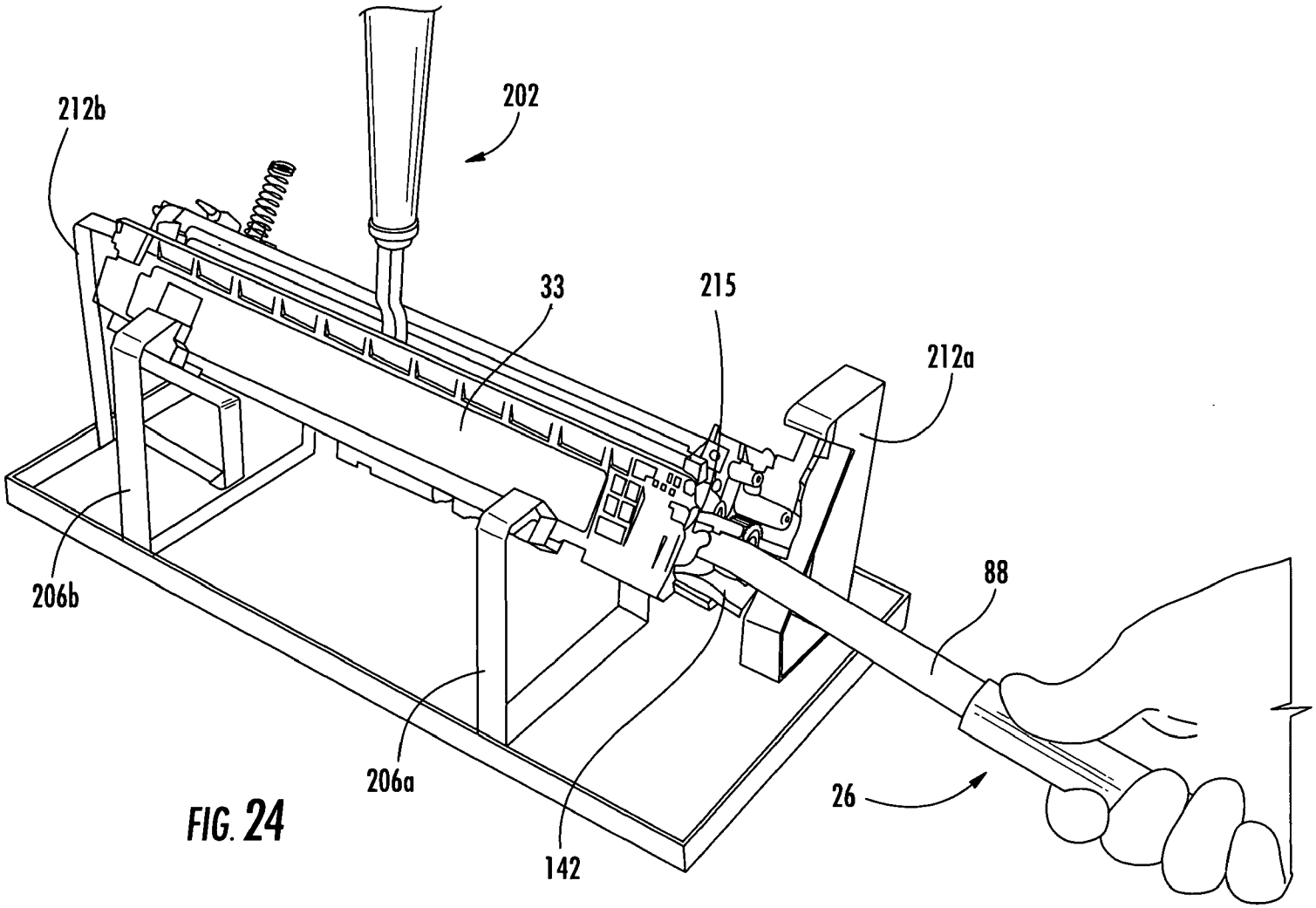
FIG. 24 is a front perspective view of the cartridge and fixture of FIG. 19 with an embodiment of a first printer cartridge seal applicator inserted in the printer cartridge and an embodiment of the seal insertion tool being removed from the printer cartridge using one of the embodiments of a toner opening port sealing method according to the disclosure.
Figure 25:
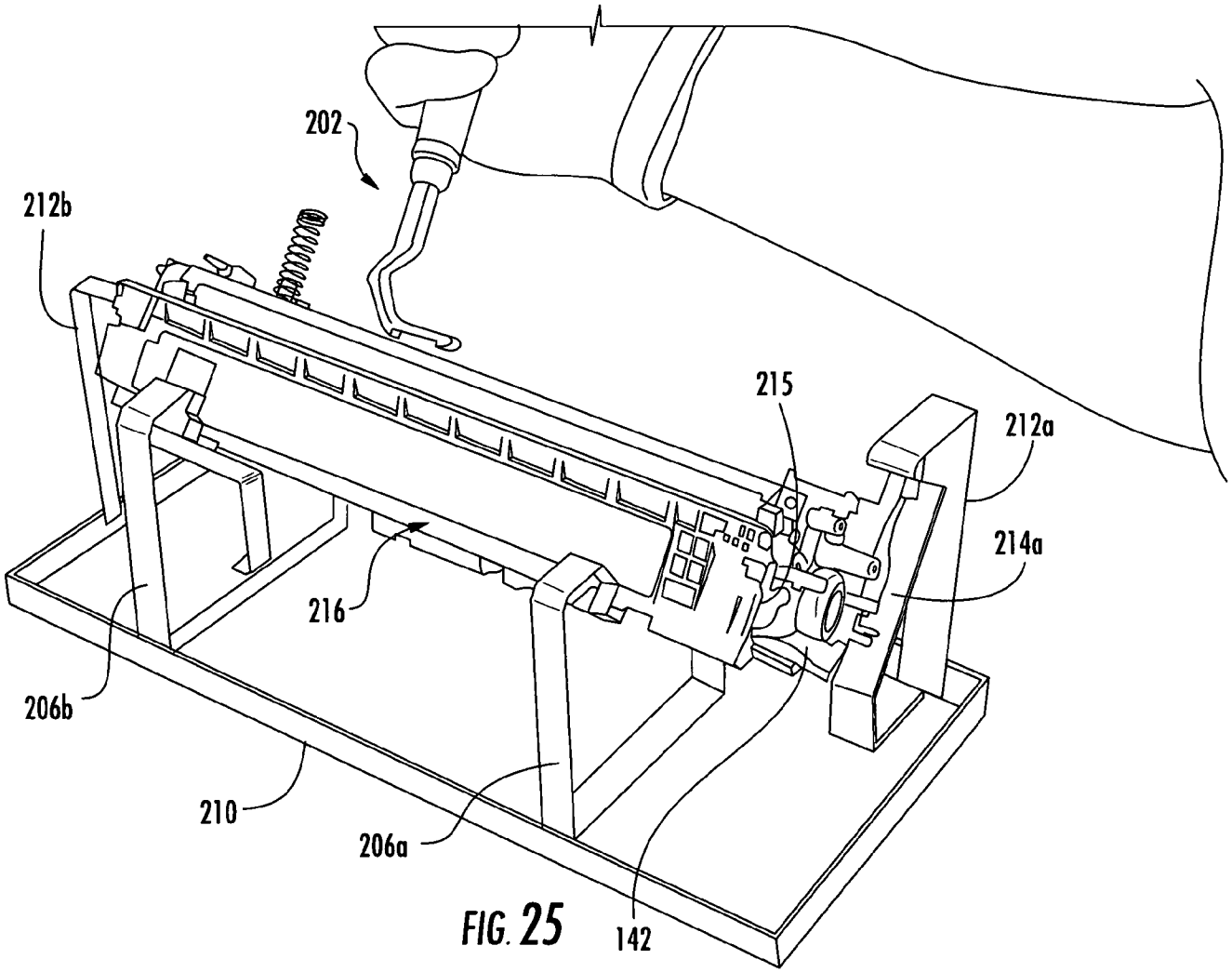
FIG. 25 is a front perspective view of the cartridge and fixture of FIG. 19 with an embodiment of a first printer cartridge seal applicator removed from the printer cartridge using one of the embodiments of a toner opening port sealing method according to the disclosure.
Figure 26:
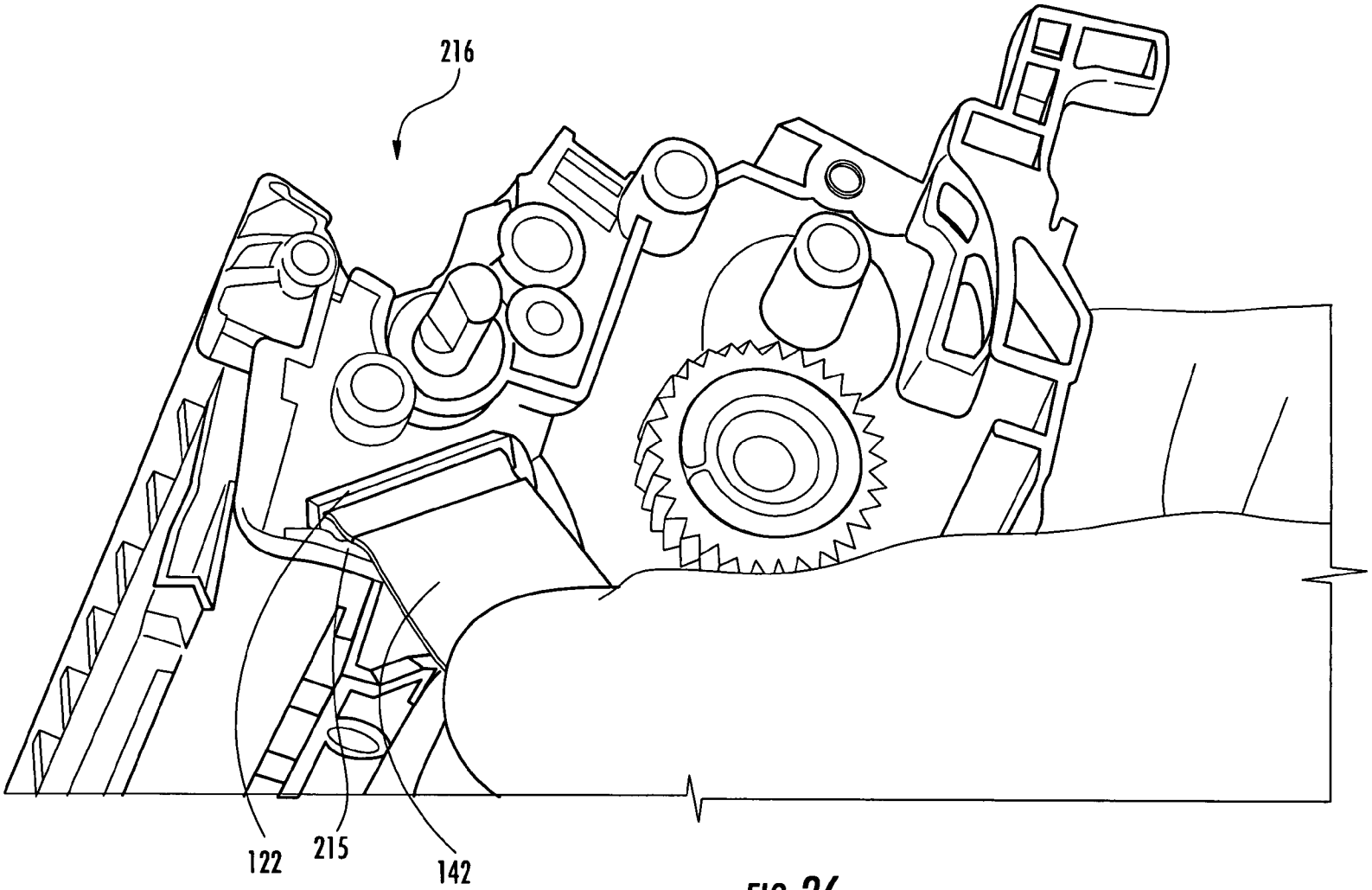
FIG. 26 is a close-up perspective view of a toner exit port and a toner exit port plug of the printer cartridge according to the disclosure.
Figure 28:
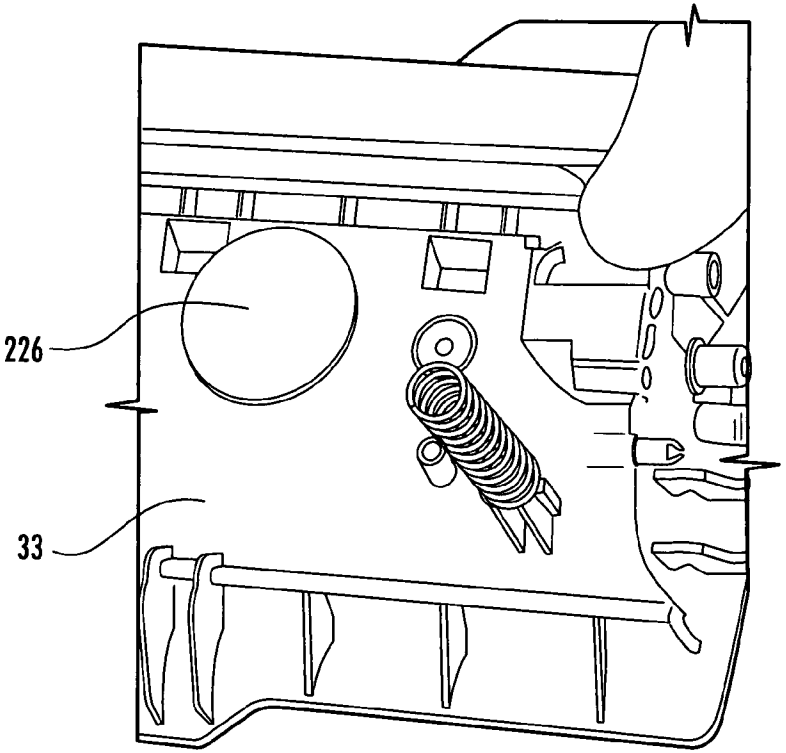
FIG. 28 is a close-up perspective view of a toner hopper of a sealed printer cartridge with a cap covering the toner hopper opening after using one of the embodiments of a toner opening port sealing method according to the disclosure.
Figure 27:
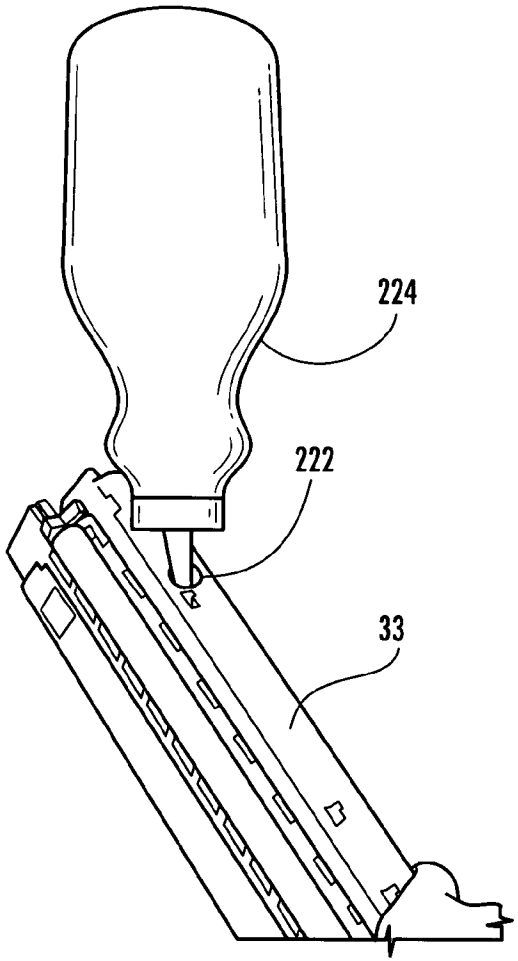
FIG. 27 is a top perspective view of a sealed printer cartridge being filled with toner through a toner hopper opening after using one of the embodiments of a toner opening port sealing method according to the disclosure.

FIG. 21 is a right side perspective view of the printer cartridge 216 and the fixture 210 of FIG. 19 with an embodiment of the first printer cartridge seal applicator 202 inserted in the toner hopper 33 of the printer cartridge 216 using one of the embodiments of a toner opening port sealing method according to the disclosure. FIG. 22 is a front perspective view of the printer cartridge 216 and the fixture 210 of FIG. 19 with an embodiment of the first printer cartridge seal applicator 202 and an embodiment of the seal insertion tool 26 both inserted in the toner hopper 33 of the printer cartridge 216 using one of the embodiments of a toner opening port sealing method according to the disclosure. FIG. 23 is a front perspective view of the printer cartridge 216 and the fixture 210 of FIG. 19 with an embodiment of the first printer cartridge seal applicator 202, an embodiment of the seal insertion tool 26, and an embodiment of the second printer cartridge seal applicator 204, all inserted in the toner hopper 33 of the printer cartridge 216 using one of the embodiments of a toner opening port sealing method according to the disclosure. FIG. 24 is a front perspective view of the printer cartridge 216 and the fixture 210 of FIG. 19 with an embodiment of the first printer cartridge seal applicator 202 inserted in the printer cartridge 216 and an embodiment of the seal insertion tool 26 being removed from the tone hopper 33 of the printer cartridge 216 using one of the embodiments of a toner opening port sealing method according to the disclosure. FIG. 25 is a front perspective view of the printer cartridge 216 and the fixture 210 of FIG. 19 with an embodiment of the first printer cartridge seal applicator 202 removed from the toner hopper 33 of the printer cartridge 216 using one of the embodiments of a toner opening port sealing method according to the disclosure. FIG. 26 is a close-up perspective view of a toner exit port 215 of the printer cartridge 216 and a toner exit port plug 122 coupled to the printer cartridge seal 142. FIG. 27 is a top perspective view of the toner hopper 33 of a sealed printer cartridge being filled through a toner hopper opening 222 with toner from a toner bottle 224 after using one of the embodiments of a toner opening port sealing method according to the disclosure. FIG. 28 is a close-up perspective view of the toner hopper 33 of a sealed printer cartridge with a cap 226 covering the toner hopper opening 222 after using one of the embodiments of a toner opening port sealing method according to the disclosure.

Figure 29:
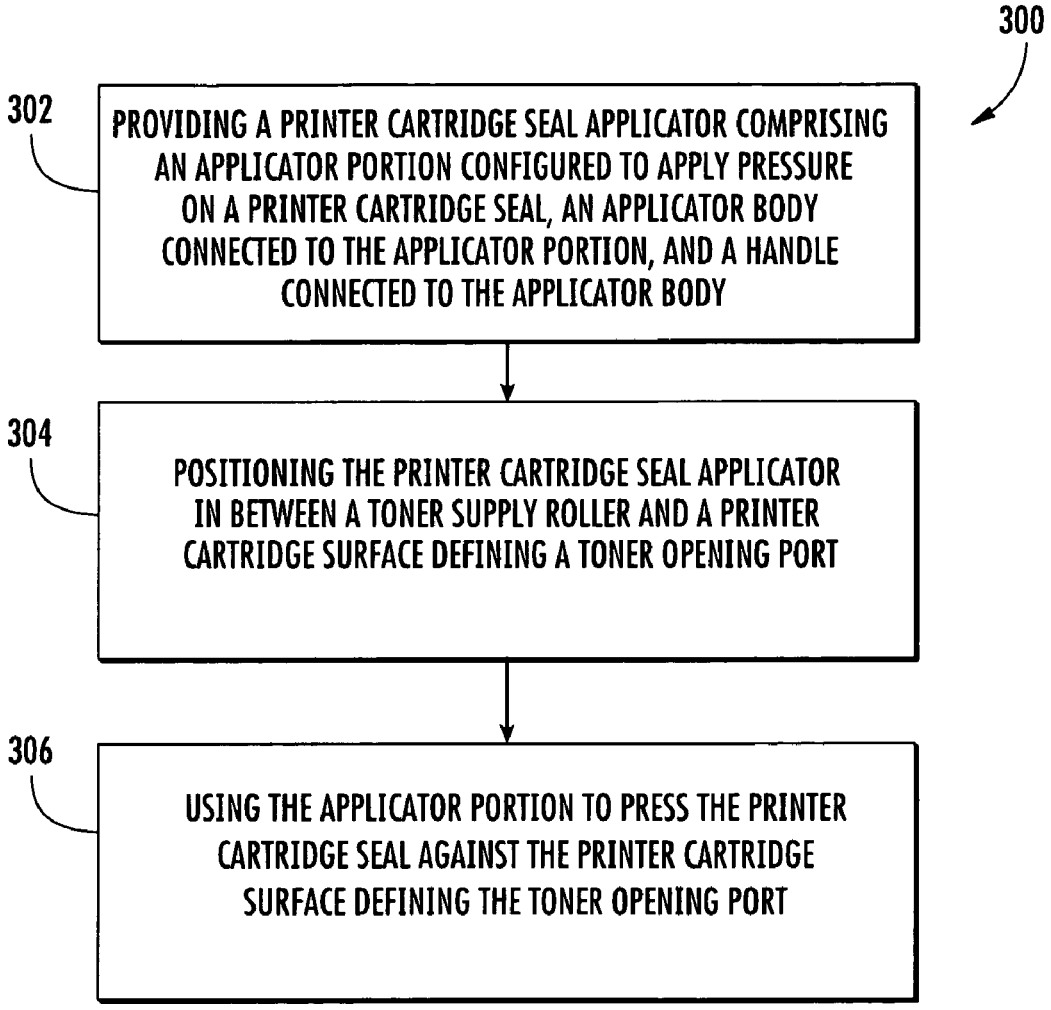
FIG. 29 is a flow diagram of an embodiment of a toner opening port sealing method according to the disclosure; and, FIG. 30 is a flow diagram of another embodiment of a toner opening port method according to the disclosure.

There is provided in another embodiment a method 300 of promoting adhesion of a printer cartridge seal 142 (see FIG. 20) or 24 (see FIG. 3) to a printer cartridge 216 (see FIG. 16-28) or 28 (see FIG. 1), and preferably to a printer cartridge portion defining a toner opening port 146. Preferably, the printer cartridge seal 142 is used to seal a toner hopper 33 portion of the printer cartridge 216. FIG. 29 is a flow diagram of an embodiment of a toner opening port sealing method 300 according to the disclosure. The method 300 comprises step 302 of providing one of the embodiments of the printer cartridge seal applicator 130 (see FIG. 10) or 204 (see FIG. 18). The printer cartridge seal applicators 130 and 204 comprise an applicator portion 138. The applicator portion 138 is configured to apply pressure on one of the embodiments of a printer cartridge seal 142 (see FIG. 20) or 24 (see FIG. 3). Each of the printer cartridge seal applicators 130, 204 further comprises an applicator body 132 connected to the applicator portion 138. The applicator body 132 preferably comprises a curved body having a concave side 134 and a convex side 136 (see FIG. 10). Each of the printer cartridge seal applicators 130, 204 further comprises a handle 148 connected to the applicator body 132. The printer cartridge seal applicators 130 or 204 may further comprise a seal contact bottom surface 140 where the seal contact bottom surface 140 is flat. The seal contact bottom surface 140 is preferably configured to press the printer cartridge seal 142 by preferably pressing against the seal insertion tool 26 positioned over the seal 142 in order to distribute pressure onto the surface of the seal. The method 300 further comprises step 304 of positioning one of the embodiments of the printer cartridge seal applicators 130, 204 in between a toner supply roller 150 (see FIGS. 10 and 21) and a printer cartridge surface 220 (see FIG. 23) or 144 (see FIG. 10) defining a toner opening port 146 (see FIGS. 10-11 and 13). The method 300 further comprises step 306 of using the applicator portion 138 to press the printer cartridge seal 142 or 24 against the printer cartridge surface 220 or 144 defining the toner opening port 146 or against a surface of the seal insertion tool 26 inserted above the seal in order to distribute pressure or force onto the seal from the printer cartridge seal applicator 130, 204. The method 300 may further comprise a step of sliding the printer cartridge seal applicator 130, 204 on or against the printer cartridge seal 142 attached to the printer cartridge surface 218 defining the toner opening port 146 or against a surface of the seal insertion tool 26. The method 300 may further comprise providing one of the embodiments of the printer cartridge seal applicators 154, 202 comprising an applicator portion 156. The applicator portion 156 is configured to align the printer cartridge seal 142 (see FIG. 20) or 24 (see FIG. 3). Each of the printer cartridge seal applicators 130, 202 further comprises an applicator body 132 connected to the applicator portion 156. The applicator body 132 preferably comprises a curved body having a concave side 134 and a convex side 136 (see FIG. 13). Each of the printer cartridge seal applicators 130, 202 further comprises a handle 148 connected to the applicator body 132. The printer cartridge seal applicators 154 or 202 may further comprise a seal contact bottom surface 158 configured to align the printer cartridge seal 142, where the seal contact bottom surface 158 defines a notch 160. The method 300 may further comprise positioning the concave side 134 of the printer cartridge seal applicator 130, 202 adjacent to the toner supply roller 150 (see FIG. 13). The method 300 may further comprise positioning a printer cartridge seal pull strip 162 (see FIG. 15) or adhesive backing, of the printer cartridge seal 142 within the notch 160 of printer cartridge seal applicators 154 or 202 (see FIG. 15). The printer cartridge seal applicators 154 or 202 may further comprise a plurality of chamfers 158*a*, 158*b* (see FIG. 14) defining the notch 160 (see FIG. 14).

Figure 30:
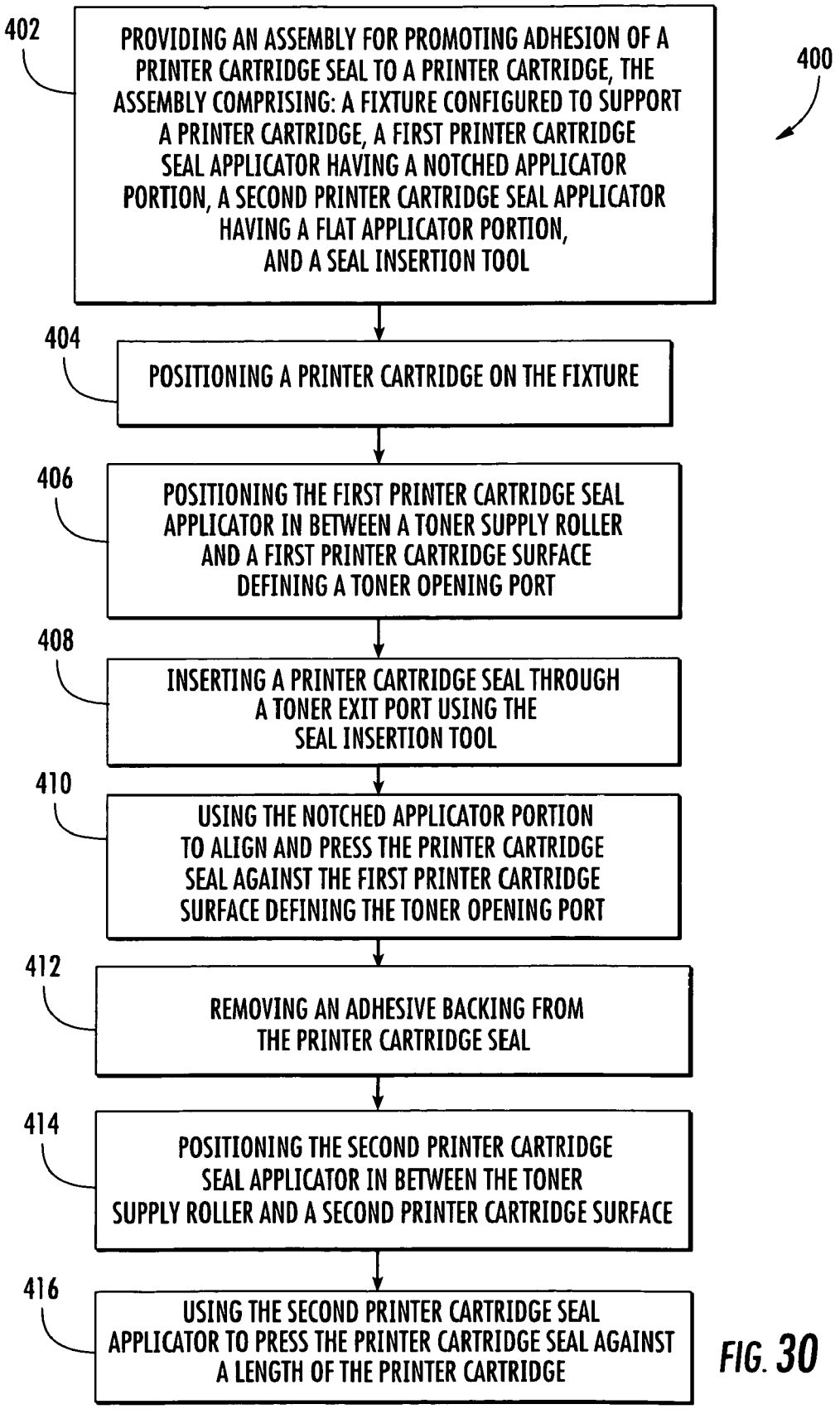

There is provided in another embodiment a method 400 of promoting adhesion of a printer cartridge seal 142 (see FIG. 20) to a printer cartridge 216 (see FIGS. 16-28), preferably a toner hopper 33 portion of the printer cartridge 216. FIG. 30 is a flow diagram of the toner opening port method 400 according to the disclosure. The method 400 comprises step 402 of providing an assembly 200 (see FIG. 16) for promoting adhesion of a printer cartridge seal 142 to a printer cartridge 216. The assembly 200 comprises a fixture 210 configured to support a printer cartridge 216, preferably a toner hopper 33 of the printer cartridge 216. The assembly 200 further comprises a first printer cartridge seal applicator 202 having a notched applicator portion 160. The assembly 200 further comprises a second printer cartridge seal applicator 204 comprising a flat applicator portion 140. The assembly 200 further comprises a seal insertion tool 26. The method 400 further comprises step 404 of positioning the printer cartridge 216, preferably, the toner hopper 33, on the fixture 210 (see FIG. 19). In particular, the toner hopper 33 of the printer cartridge 216 is secured onto the retaining portions 208*a*, 208*b*, 214*a*, 214*b*. The method 400 further comprises step 406 of positioning the first printer cartridge seal applicator 202 in between a toner supply roller 150 (see FIG. 21) and a first printer cartridge surface 218 defining a toner opening port 146 (see FIGS. 10-11 and 13). Preferably, the first cartridge seal applicator 202 is initially placed toward the center of the toner hopper 33 of the printer cartridge 216 and pushed downwardly until the desired portion sits firmly in the toner hopper interior of the printer cartridge 216. The method 400 further comprises step 408 of inserting the printer cartridge seal 142 through a toner exit port 215 (see FIG. 22) using the seal insertion tool 26. The printer cartridge seal 142 is preferably inserted into the toner exit port 215 so that a base of the printer cartridge seal 142 touches an interior surface of the toner hopper 33 of the printer cartridge 216. The printer cartridge seal 142 is preferably fully inserted into the entire length of a seal area within the toner hopper to avoid leakage of toner. The method 400 further comprises step 410 of using the notched applicator portion 160 of the first printer cartridge seal applicator 202 to align and press the printer cartridge seal 142 against the first printer cartridge surface 218 (see FIG. 23) defining the toner opening port 146 (see FIG. 13). The first printer cartridge seal applicator 202 may be moved to the end of the cartridge opposite the toner exit port 215 to align the seal within the cartridge. The method 400 further comprises step 412 of removing an adhesive backing or seal pull strip 162 (see FIG. 15) from the printer cartridge seal 142. The seal insertion tool 26 may be removed from the toner exit port 215 and then reinserted into the toner exit port 215 so that the surface of the seal insertion tool 26 may rest on the seal. The method 400 further comprises step 414 of positioning the second printer cartridge seal applicator 204 in between the toner supply roller 150 and a second printer cartridge surface 220 (see FIG. 23). The method 400 further comprises step 416 of using the second printer cartridge seal applicator 204 to press the printer cartridge seal 142 against a length of the printer cartridge 216, preferably, a length of the toner hopper. The second printer cartridge seal applicator 204 preferably applies pressure on the middle and on both sides of the length of the seal by applying pressure against the surface of the seal insertion tool 26 above the seal so as to distribute force or pressure onto the surface of the seal when the seal insertion tool is used. The method 400 may further comprise sliding the second printer cartridge seal applicator 204 along seal insertion tool 26 and the printer cartridge seal 142 to assist in attaching the printer cartridge seal 142 to a length of the printer cartridge surface or portion defining the toner opening port 146. Once the printer cartridge seal 142 is sufficiently adhered to the surface or portion of the printer cartridge, preferably the toner hopper portion, the second printer cartridge seal applicator 204, and the first printer cartridge seal applicator 202 if present, are removed from the printer cartridge 216, and a toner exit port plug 122 is inserted over the end of the inserted printer cartridge seal 142 (see FIG. 26), and the toner hopper may be filled through the toner hopper opening 222 with toner from a toner bottle 224 and then sealed with a cap 226 (see FIGS. 27-28).

It can now be realized that the disclosure provides devices and techniques for effectively sealing a toner opening port of a printer cartridge. The disclosure provides a way of applying adequate pressure to a toner opening port seal so that the seal may adhere very well around the toner opening port. A seal that adheres very well around the toner opening port can effectively prevent toner from exiting the toner opening port prior to the use of the printer cartridge. The disclosure also provides a device and technique for providing a seal that prevents or minimizes displacing a toner exit port plug when the seal is being detached from the printer cartridge. Thus, the disclosed embodiments can prevent toner from further exiting the printer cartridge through the toner exit port. Finally, the disclosure provides a fixture that provides ease during printer cartridge remanufacturing work, such as when sealing the printer cartridge, creating a toner refill hole, and refilling the cartridge with toner.

Although the description above contains many specifications, these should not be construed as limiting the scope of the invention but as merely providing illustrations of some of the preferred disclosed embodiments. For example, the shape of the base fixture may vary. Various clamp designs may be adopted. The invention is capable of other embodiments and of being practiced and carried out in various ways. The invention is not limited in its application to the details of the construction and to the arrangement of the components set forth in the above description or as illustrated in the drawings.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A printer cartridge seal applicator comprising:

an applicator portion, the applicator portion configured to apply pressure on a printer cartridge seal, the applicator portion defining a notch, the notch being configured to accommodate a printer cartridge seal pull strip, the printer cartridge seal comprising an adhesive;

an applicator body connected to the applicator portion, the applicator body configured to support the applicator portion; and, a handle connected to the applicator body, wherein when the adhesive of the printer cartridge seal is exposed, the printer cartridge seal applicator substantially promotes adhesion of the adhesive of the printer cartridge seal to a printer cartridge portion.

2. The printer cartridge seal applicator of claim 1, wherein the applicator body comprises a concave side, a portion of the concave side configured to be positioned adjacent to a toner supply roller, the applicator body further comprising a convex side.

3. The printer cartridge seal applicator of claim 2, wherein the applicator portion comprises a flat surface, the flat surface being connected to the convex side of the applicator body, the flat surface being configured to allow the applicator body to slide on the printer cartridge seal to promote adhesion of the adhesive of the printer cartridge seal throughout a length of the printer cartridge seal.

4. The printer cartridge seal applicator of claim 2, wherein the handle may be used to position the concave side of the applicator body adjacent to the toner supply roller and position the applicator portion in between the toner supply roller and a printer cartridge surface defining a toner opening port.

5. The printer cartridge seal applicator of claim 1, wherein the applicator portion comprises a plurality of chamfers, the plurality of chamfers defining a notch substantially in between the plurality of chamfers, the notch being configured to accommodate the printer cartridge seal pull strip.

6. A device for promoting adhesion of a printer cartridge seal to a printer cartridge, the device comprising:

an applicator means for applying pressure to the printer cartridge seal, the applicator means defining a notch configured to accommodate a pull strip of the printer cartridge seal; and, a handle means for positioning the applicator means in between a toner supply roller and a printer cartridge portion defining a toner opening port, the handle means connected to the applicator means.

7. The device of claim 6, further comprising a body means for supporting the handle means, the body means being connected to the handle means on one end and the applicator means on the other end.

8. The device of claim 7, wherein the body means is a curved body, the curved body comprising a concave side and a convex side, the concave side being configured to accommodate a toner supply roller adjacent to it.

9. The device of claim 6, wherein the applicator means comprises a plurality of chamfers, the plurality of chamfers defining a notch in between the plurality of chamfers, the notch configured to accommodate the pull strip of the printer cartridge seal.

10. The device of claim 9, wherein each of the plurality of chamfers comprises a substantially flat surface, the substantially flat surface configured to press the printer cartridge seal against a printer cartridge surface defining a toner opening port.

11. The device of claim 6, wherein the applicator means comprises a substantially flat surface configured to press on the printer cartridge seal.

12. An assembly for promoting adhesion of a printer cartridge seal to a printer cartridge portion that defines a toner opening port, the toner opening port being accessible through a toner exit port, the assembly comprising:

a fixture configured to support a printer cartridge, the fixture comprising a plurality of walls configured to minimize movement of the printer cartridge;

a first printer cartridge seal applicator comprising:

a notched applicator portion configured to accommodate a printer cartridge seal pull strip;

a first printer cartridge seal applicator body connected to the notched applicator portion; and, a first printer cartridge seal applicator handle connected to the first printer cartridge seal applicator body;

a second printer cartridge seal applicator comprising:

a flat applicator portion configured to apply pressure on the printer cartridge seal;

a second printer cartridge seal applicator body connected to the flat applicator portion; and, a second printer cartridge seal applicator handle connected to the second printer cartridge seal applicator body; and, a seal insertion tool for inserting the printer cartridge seal through the toner exit port.

13. A method of promoting adhesion of a printer cartridge seal to a printer cartridge, the method comprising:

providing a printer cartridge seal applicator comprising:

an applicator portion configured to apply pressure on the printer cartridge seal, the applicator portion defining a notch configured to accommodate a pull strip of the printer cartridge seal;

an applicator body connected to the applicator portion; and, a handle connected to the applicator body;

positioning the printer cartridge seal applicator in between a toner supply roller and a printer cartridge surface defining a toner opening port; and, using the applicator portion to press the printer cartridge seal against the printer cartridge surface defining the toner opening port.

14. The method of claim 13, further comprising sliding the printer cartridge seal applicator on the printer cartridge seal attached to the printer cartridge surface defining the toner opening port.

15. The method of claim 13, wherein the printer cartridge seal applicator comprises a curved body, the curved body comprising a concave side, the method further comprising positioning the concave side adjacent to the toner supply roller.

16. The method of claim 13, wherein the printer cartridge seal applicator comprises a plurality of chamfers, the plurality of chamfers defining a notch, the method further comprising positioning the pull strip of the printer cartridge seal within the notch.

17. The method of claim 13, wherein the applicator portion comprises a seal contact bottom surface configured to press the printer cartridge seal, the seal contact bottom surface defining a notch, the method further comprising positioning the pull strip of the printer cartridge seal within the notch.

18. A method of promoting adhesion of a printer cartridge seal to a printer cartridge, the method comprising:

providing an assembly for promoting adhesion of a printer cartridge seal to a printer cartridge, the assembly comprising:

a fixture configured to support a printer cartridge;

a first printer cartridge seal applicator having a notched applicator portion;

a second printer cartridge seal applicator having a flat applicator portion; and, a seal insertion tool;

positioning the printer cartridge on the fixture;

positioning the first printer cartridge seal applicator in between a toner supply roller and a first printer cartridge surface defining a toner opening port;

inserting the printer cartridge seal through a toner exit port using the seal insertion tool;

using the notched applicator portion to align and press the printer cartridge seal against the first printer cartridge surface defining the toner opening port;

removing an adhesive backing from the printer cartridge seal;

positioning the second printer cartridge seal applicator in between the toner supply roller and a second printer cartridge surface;

using the second printer cartridge seal applicator to press the printer cartridge seal against a length of the printer cartridge.

* * * * *